US010619407B2

(12) United States Patent
Kawabe et al.

(10) Patent No.: US 10,619,407 B2
(45) Date of Patent: Apr. 14, 2020

(54) SLIDING FIRE DOOR

(71) Applicant: Daifuku Co., Ltd., Osaka-shi (JP)

(72) Inventors: Naoki Kawabe, Tokyo (JP); Nobuo Ogawa, Tokyo (JP); Yoshihiro Hosaka, Komaki (JP); Takafumi Yamazaki, Hinocho (JP)

(73) Assignee: Daifuku Co., Ltd., Osaka-shi (JP)

( * ) Notice: Subject to any disclaimer, the term of this patent is extended or adjusted under 35 U.S.C. 154(b) by 42 days.

(21) Appl. No.: 15/992,687

(22) Filed: May 30, 2018

(65) Prior Publication Data

US 2018/0347263 A1 Dec. 6, 2018

(30) Foreign Application Priority Data

May 31, 2017 (JP) ..... 2017-108359

(51) Int. Cl.

| | |
|---|---|
| ***E05D 13/00*** | (2006.01) |
| ***E06B 5/16*** | (2006.01) |
| ***E06B 3/46*** | (2006.01) |
| ***E05D 15/06*** | (2006.01) |

(52) U.S. Cl.

CPC ..... *E06B 5/164* (2013.01); *E05D 15/0665* (2013.01); *E05D 15/0686* (2013.01); *E05D 15/0691* (2013.01); *E06B 3/4654* (2013.01); *E05Y 2800/12* (2013.01); *E05Y 2800/25* (2013.01); *E05Y 2900/134* (2013.01)

(58) Field of Classification Search

CPC . E05D 15/06; E05D 15/0665; E05D 15/0682; E05D 15/0691; E05Y 2900/134; B61D 19/00

USPC ..... 49/209, 210, 211, 425

See application file for complete search history.

(56) References Cited

U.S. PATENT DOCUMENTS 115,333 A * 5/1871 Lyons ..... E05D 15/0669 16/100
286,997 A * 10/1883 Campbell ..... F16C 29/045 384/58
562,141 A * 6/1896 McElroy ..... B61B 1/005 104/27

(Continued)

FOREIGN PATENT DOCUMENTS

DE 102018108180 A1 * 11/2018 ..... E05D 15/56
JP 7176587 A 7/1995

*Primary Examiner* — Jerry E Redman

(74) *Attorney, Agent, or Firm* — The Webb Law Firm

(57) ABSTRACT

A sliding fire door is disclosed with an improved tightness of the closure by the door main body. The sliding fire door includes an opening frame, a fire door, and a guiding mechanism. The guiding mechanism includes a guide roller group which includes a plurality of guide rollers arranged one adjacent to another along the slide direction and which is configured to guide the door main body. The guiding mechanism is configured to guide the door main body such that the door main body is moved from an opening position to a closing position. The door main body has a first opposing surface which is oriented toward the wall. The opening frame has a second opposing surface which is oriented toward the first opposing surface of the door main body in the closing position. The guiding mechanism moves the door main body to cause the first opposing surface to be moved closer to the second opposing surface when the door main body is moved from the opening position to the closing position.

7 Claims, 13 Drawing Sheets

(56) References Cited

U.S. PATENT DOCUMENTS 678,407 A * 7/1901 Lee ..... B63B 19/00 114/120
873,115 A * 12/1907 Asoue ..... E05D 15/165 160/201
1,329,326 A * 1/1920 Parsons ..... E05D 15/06 16/89
2,530,724 A * 11/1950 Pierson ..... E06B 3/4681 49/209
2,740,168 A * 4/1956 Wright ..... B64C 1/14 49/217
2,838,147 A * 6/1958 Downs ..... E06B 3/4681 49/209
2,971,228 A * 2/1961 Szabo ..... E06B 3/4609 49/209
3,138,830 A * 6/1964 Scharge ..... E05D 15/066 49/130
3,224,382 A * 12/1965 Floehr ..... B61D 7/22 105/282.2
3,226,777 A * 1/1966 Kollsman ..... E05D 15/0678 49/130
3,320,700 A * 5/1967 Bohn ..... E06B 3/4609 49/404
3,517,459 A * 6/1970 Schupper ..... E05D 15/0665 49/425
3,611,637 A * 10/1971 Saino ..... E05D 15/1021 49/235
4,341,043 A * 7/1982 Yamamoto ..... E06B 7/18 49/209
4,476,652 A * 10/1984 Beauchot ..... E05D 15/063 16/106
4,575,966 A * 3/1986 Gerritsen ..... E05D 15/0682 49/209
4,644,690 A * 2/1987 Caimi ..... E05D 15/10 49/128
5,280,686 A * 1/1994 Davies ..... E05B 65/0864 49/209
5,542,213 A * 8/1996 Freeman ..... E05D 15/10 49/220
5,566,505 A * 10/1996 Kamezaki ..... E05D 15/1021 49/225
6,017,105 A * 1/2000 Goughnour ..... E05D 15/1042 312/209
6,826,867 B1 * 12/2004 McDonald ..... E05B 65/0835 49/209
7,610,718 B2 * 11/2009 Kopish ..... E05D 15/1042 49/209
7,896,425 B2 * 3/2011 Elliott ..... E05D 15/0608 16/359
2012/0005964 A1 * 1/2012 Isaacs ..... E05D 15/066 49/452
2016/0340966 A1 * 11/2016 Hosaka ..... E06B 5/167
2019/0264484 A1 * 8/2019 Tuminella ..... E05D 15/1042

* cited by examiner

SLIDING FIRE DOOR

CROSS-REFERENCE TO RELATED APPLICATION

This application claims priority to Japanese Patent Application No. 2017-108359 filed May 31, 2017, the disclosure of which is hereby incorporated in its entirety by reference.

FIELD OF THE INVENTION

The present invention relates to a sliding fire door provided to a wall which has an opening formed therein, and comprising an opening frame at least a portion of which frames the opening, a fire door configured to leave open and close the opening, and a guiding mechanism configured to guide the door main body along a slide direction parallel to the wall.

BACKGROUND

A conventional example of such a sliding fire door is described in JP Publication of application No. H07-176587. The sliding fire door described in this official report includes guide rails that extend along the slide direction as a guiding mechanism for guiding a door main body. The guide rails support guide rollers provided to the door main body, allowing the door main body to move along the slide direction.

And this sliding fire door is configured to, when a fire breaks out, allow the door main body in an opening position to be moved along the slide direction to a closing position to close the opening with the door main body.

SUMMARY OF THE INVENTION

In such a sliding fire door, a gap is formed between a first opposing surface of the door main body that is oriented toward a wall and a second opposing surface of an opening frame that is oriented toward the first opposing surface, in order to reduce resistance during the movement of the door main body along the slide direction. The tightness of the closure, or the degree of tightness with which the opening is closed by the door main body, is reduced when a gap is formed between the first opposing surface and the second opposing surface. Thus, there is room for improving tightness of the closure of the opening by the door main body. In addition, it is also desirable to reduce any increase in the manufacturing cost of such a sliding fire door.

Thus, it is desirable to have a sliding fire door with an improved tightness of the closure of the opening by the door main body while reducing any increase in its manufacturing cost.

A sliding fire door provided to a wall which has an opening formed therein, the sliding fire door comprises: an opening frame at least a portion of which frames the opening; a fire door configured to leave open and close the opening; a guiding mechanism configured to guide the door main body along a slide direction parallel to the wall; wherein the guiding mechanism includes a guide roller group which includes a plurality of guide rollers arranged one adjacent to another along the slide direction and which is configured to guide the door main body, wherein the guiding mechanism is configured to guide the door main body such that the door main body is allowed to be moved along the slide direction from an opening position for leaving open the opening to a closing position for closing the opening, wherein the door main body has a first opposing surface which is oriented toward the wall, wherein the opening frame has a second opposing surface which is oriented toward the first opposing surface of the door main body in the closing position, and wherein the guiding mechanism includes at least one displacing mechanism configured to move the door main body in such a direction as to cause the first opposing surface to be moved closer to the second opposing surface, when the door main body is moved from the opening position to the closing position.

With such an arrangement, since the door main body is guided by the plurality of guide rollers arranged one adjacent to another along the slide direction, the door main body can be smoothly moved from the opening position to the closing position. By so providing the plurality of guide rollers arranged one adjacent to another along the slide direction to guide the door main body with the plurality of guide rollers, it becomes unnecessary to install any rails extending along the slide direction as with the case where rollers are provided to the door main body. Thus, the cost of the sliding fire door can be reduced.

And when the door main body is moved from the opening position to the closing position, the door main body is moved in such a direction as to cause the first opposing surface of the door main body to be moved closer to the second opposing surface of the opening frame. This can eliminate or reduce the gap between the door main body and the opening frame; thus, the opening can be closed more tightly by the door main body.

As such, the arrangement described above makes it easier to improve tightness of the closure of the opening by the door main body while reducing any increase in its manufacturing cost.

DETAILED DESCRIPTION

1. Embodiments

As an embodiment of a sliding fire door, an article transport facility provided with such a sliding fire door is described with reference to the attached drawings.

Figure 1:
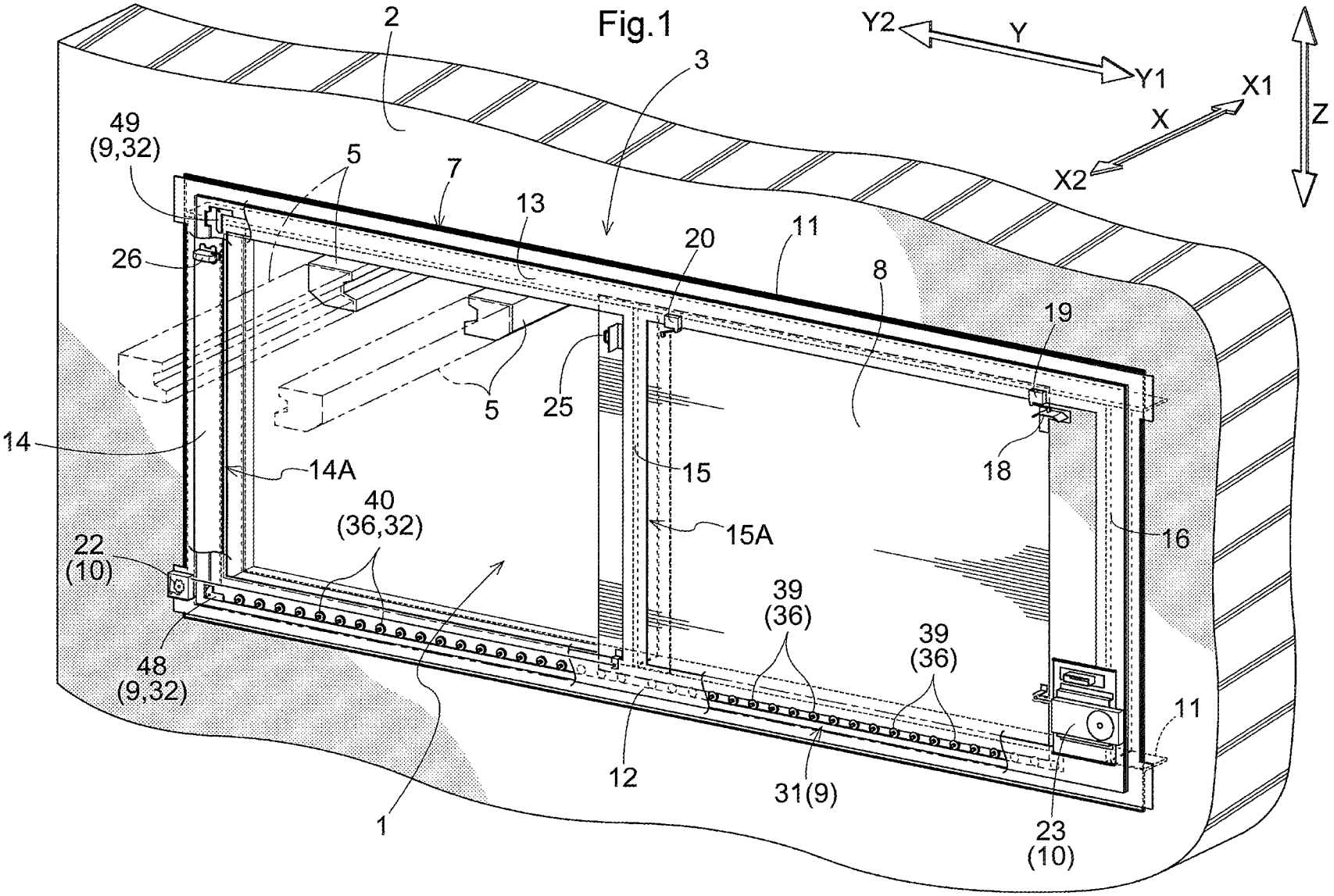
FIG. 1 is a perspective view of a sliding fire door.

As shown in FIG. 1, the facility includes a wall 2 which has an opening 1 formed therein, a sliding fire door 3 which is provided to the wall 2 to leave open and close the opening 1, and travel rails 5 for supporting a ceiling or overhead transport vehicle (not shown) and for guiding the ceiling transport vehicle along a travel path.

The travel rails 5 are installed near the ceiling such that they extend through the opening 1. The travel rails 5 are installed to extend between and through an area formed on the first-side X1 along a front-and-back direction X, of the wall 2 and an area formed on the second-side X2 along the front-and-back direction X of the wall 2. The ceiling transport vehicle travels along the travel rails 5 through the opening 1 along the front-and-back direction X to transport one or more articles. Note that a direction along or of the thickness of the wall 2 is referred to as the front-and-back direction X and one direction along (i.e., parallel to) the front-and-back direction X is referred to as the first-side direction X1 along the front-and-back direction X (or the first-side X1 along the front-and-back direction X when referring to a side with respect to an object such as the wall 2 that corresponds to the first-side direction X1) whereas the opposite direction along the front-and-back direction X is referred to as the second-side direction X2 (or the second-side X2 along the front-and-back direction X) along the front-and-back direction X. In addition, as seen along a vertical direction Z, a direction perpendicular to the front-and-back direction X will be referred to as be the right-and-left direction Y and one direction along the right and left direction Y is referred to as the first-side direction Y1 along the right-and-left direction Y (or the first-side Y1 along the right-and-left direction Y when referring to a side with respect to an object that corresponds to the first-side direction Y1) whereas the opposite direction along the right-and-left direction Y will be referred to as the second-side direction Y2 along the right-and-left direction Y (or the second-side Y2 along the right-and-left direction Y).

The sliding fire door 3 is installed to the surface of the wall 2 that is oriented, or faces, in the second-side direction X2 along the front-and-back direction. The sliding fire door 3 has an opening frame 7 at least a portion of which frames the opening 1, the door main body 8 configured to leave open and close the opening 1, a guiding mechanism 9 configured to guide the door main body 8 along the right and left direction Y, and an operating mechanism 10 configured to open and close the door main body 8. When a member (such as the opening frame 7 or a portion thereof) is described to "frame" the opening 1, it means that the member is fixed to the wall 2 in which the opening 1 is formed such that the entire opening 1 is encircled by, or located inside, the outer boundary of the member as seen along a direction of thickness of the wall 2 (i.e., along the first-side direction X1 along the front-and-back direction X in the present embodiment) and such that an opening defined by the member (such as the opening frame 7 or a portion thereof) overlaps with at least a portion of the opening 1 formed in the wall 2 as seen along the direction of thickness of the wall 2. The guiding mechanism 9 includes a guide roller group 31 and displacing mechanisms 32. Note that the right and left direction Y is the slide direction which is horizontal and parallel to the wall 2.

[Opening Frame]

Figure 2:
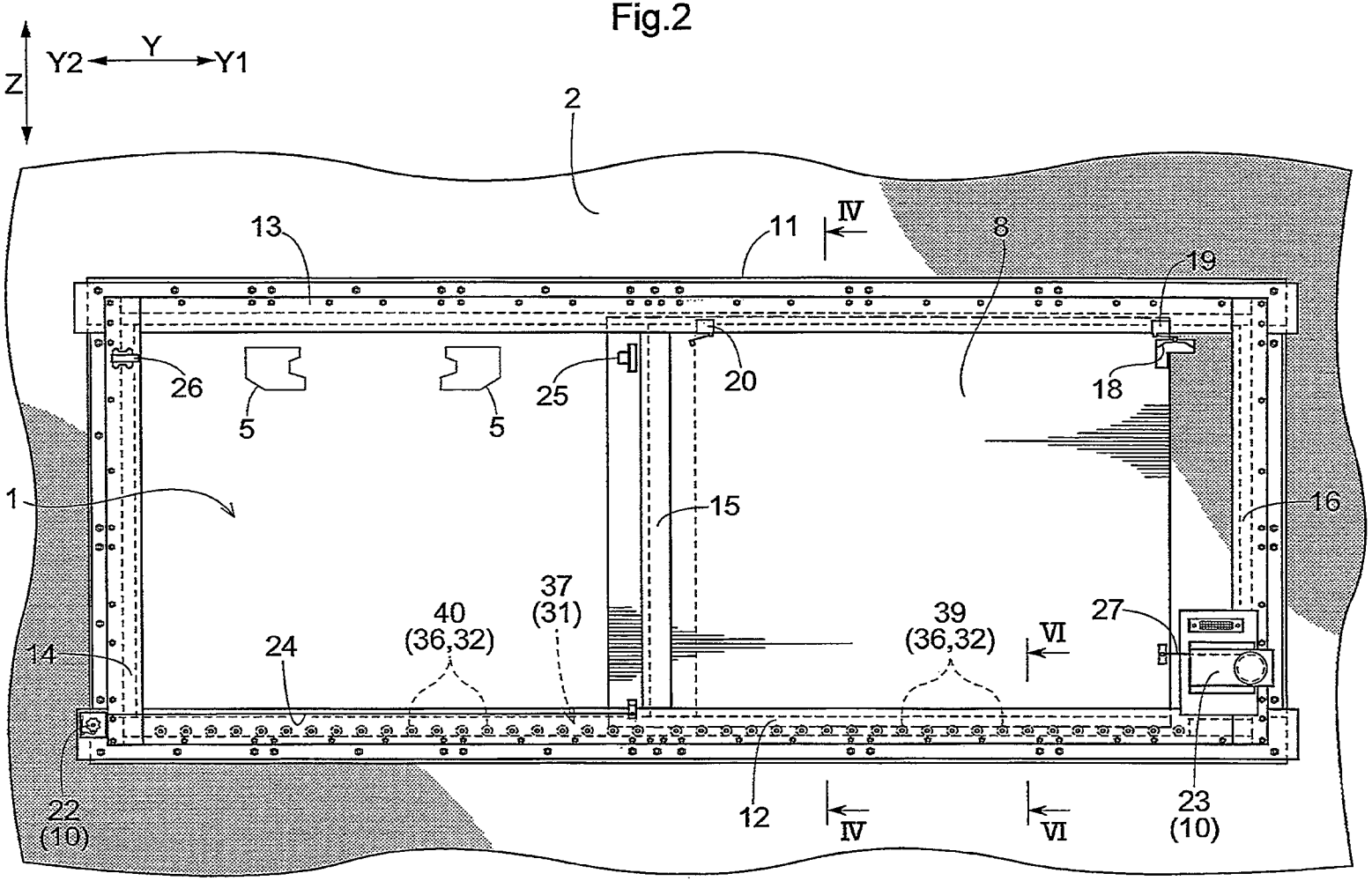
FIG. 2 is a front view of the sliding fire door with its door main body in an opening position.
Figure 3:
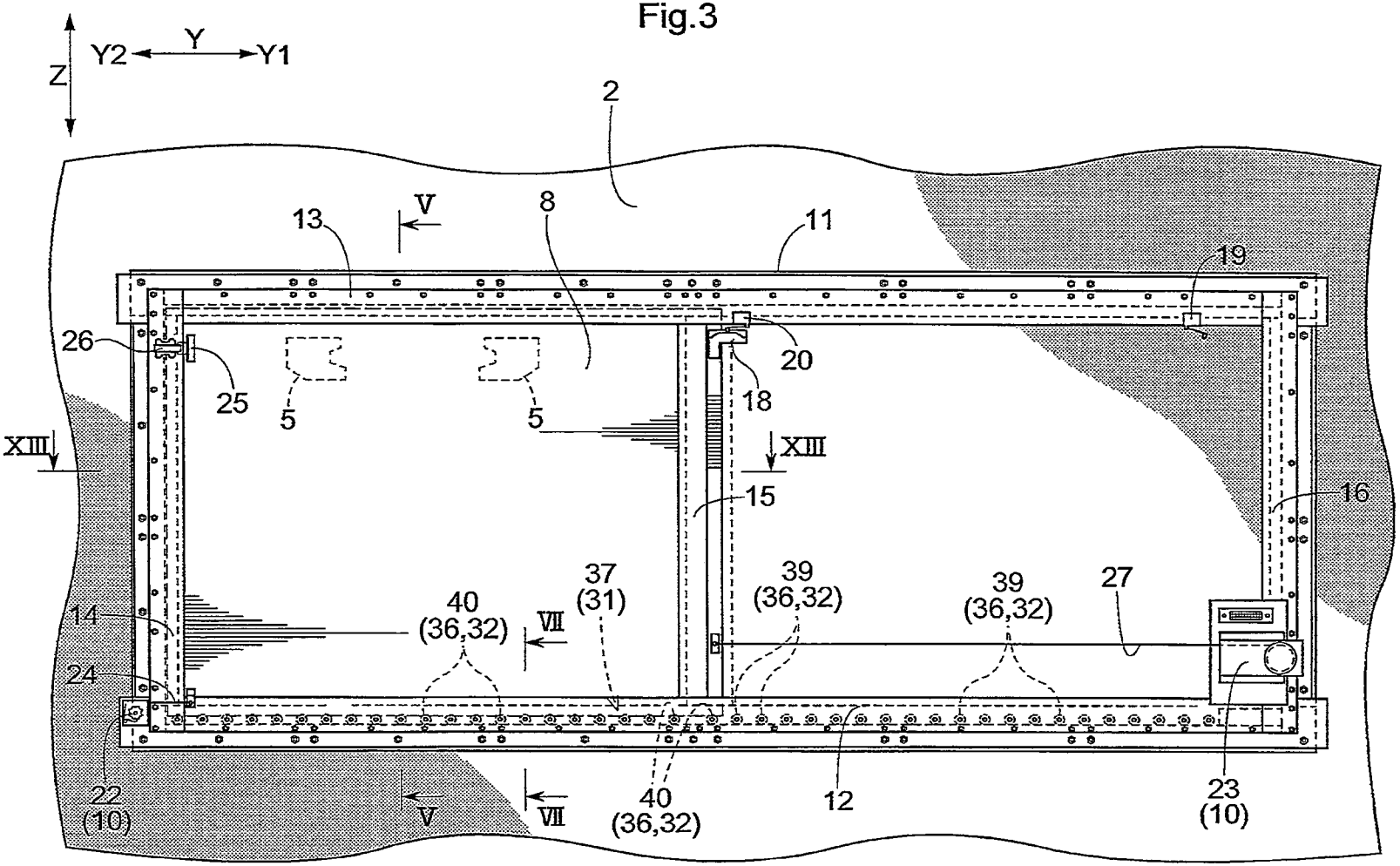
FIG. 3 is a front view of the sliding fire door with its door main body in a closing position.

As shown in FIGS. 1 through 3, the opening frame 7 has one or more base frame members 11, a lower frame member 12, an upper frame member 13, a first vertical frame member 14, a second vertical frame member 15, and a third vertical frame member 16. The one or more base frame members 11 are fixed to a steel frame member 17 of the wall 2 (see FIG. 4) by means of any fasteners, such as bolts and nuts. Note that, when the wall 2 is made of concrete or includes a concrete portion, the one or more base frame members 11 may be fixed directly to the concrete portion of the wall 2. Each of the lower frame member 12, the upper frame member 13, the first vertical frame member 14, the second vertical frame member 15, and the third vertical frame member 16 is fixed to (the corresponding one of) the corresponding one or more of the one or more base frame members 11. Each of the lower frame member 12, the upper frame member 13, the first vertical frame member 14, the second vertical frame member 15, and the third vertical frame member 16 is formed in an elongate shape. The lower frame member 12, the upper frame member 13, the first vertical frame member 14, the second vertical frame member 15, and the third vertical frame member 16 are formed separately. In addition, the lower frame member 12 may consist of a plurality of frame member portions joined end to end lengthwise. Each of the upper frame member 13, the first vertical frame member 14, the second vertical frame member 15, and the third vertical frame member 16 may likewise consist of a plurality of frame member portions joined end to end lengthwise.

The lower frame member 12 and the upper frame member 13 are each positioned to extend (i.e. each arranged in such an attitude that each extends) along the right and left direction Y. The upper frame member 13 is so located to be spaced apart upward from the lower frame member 12.

The first vertical frame member 14, the second vertical frame member 15, and the third vertical frame member 16 are each positioned to extend (i.e. each arranged in such an attitude that each extends) along the vertical direction Z. The second vertical frame member 15 is so located to be spaced apart, in the first-side direction Y1 along the right and left direction Y, from the first vertical frame member 14 whereas the third vertical frame member 16 is so located to be spaced apart, in the first-side direction Y1 along the right and left direction Y, from the second vertical frame member 15. The lower end of each of the first vertical frame member 14, the second vertical frame member 15, and the third vertical frame member 16 is connected with the lower frame member 12 whereas the lower end of each of the first vertical frame member 14, the second vertical frame member 15, and the third vertical frame member 16 is connected with the upper frame member 13.

The opening frame 7 is fixed to the wall 2 such that the opening 1 is located within a rectangular frame formed by a portion of the lower frame member 12, a portion of the upper frame member 13, the first vertical frame member 14, and the second vertical frame member 15 as seen along a direction of the thickness of the wall 2 (i.e. along the first side direction X1 along the front-and-back direction X in the present embodiment). As such, the entire opening 1 formed in the wall 2 is encircled, or located inside, the outer boundary of a portion of the opening frame 7 (with the portion being the combination of a portion of the lower frame member 12, a portion of the upper frame member 13, first vertical frame member 14, and the second vertical frame member 15 and with the outer boundary (as opposed to the inner boundary delineating an opening) being formed by the outer edges of a portion of the lower frame member 12, a portion of the upper frame member 13, first vertical frame member 14, and the second vertical frame member 15 with the portions of the outer boundary that correspond to the outer edges of the first and second vertical frame members 14, 15 extended vertically to the points where they meet the outer edge (or the lower edge) of the lower frame member 12 and the outer edge (or the upper edge) of the upper frame member 13, to close the outer boundary)) as seen along a direction of thickness of the wall 2 (i.e., along the first-side direction X1 along the front-and-back direction X in the present embodiment). And a rectangular opening defined by the combination of a portion of the lower frame member 12, a portion of upper frame member 13, first vertical frame member 14, and the second vertical frame member 15 overlaps with at least a portion of the opening 1 formed in the wall 1 as seen along the direction of thickness of the wall 2. And the entire opening frame 7 (and therefore the portion thereof) is fixed to the wall 2 in which the opening 1 is formed. Therefore, this portion of the opening frame 7 in the present example frames the opening 1.

Figure 4:
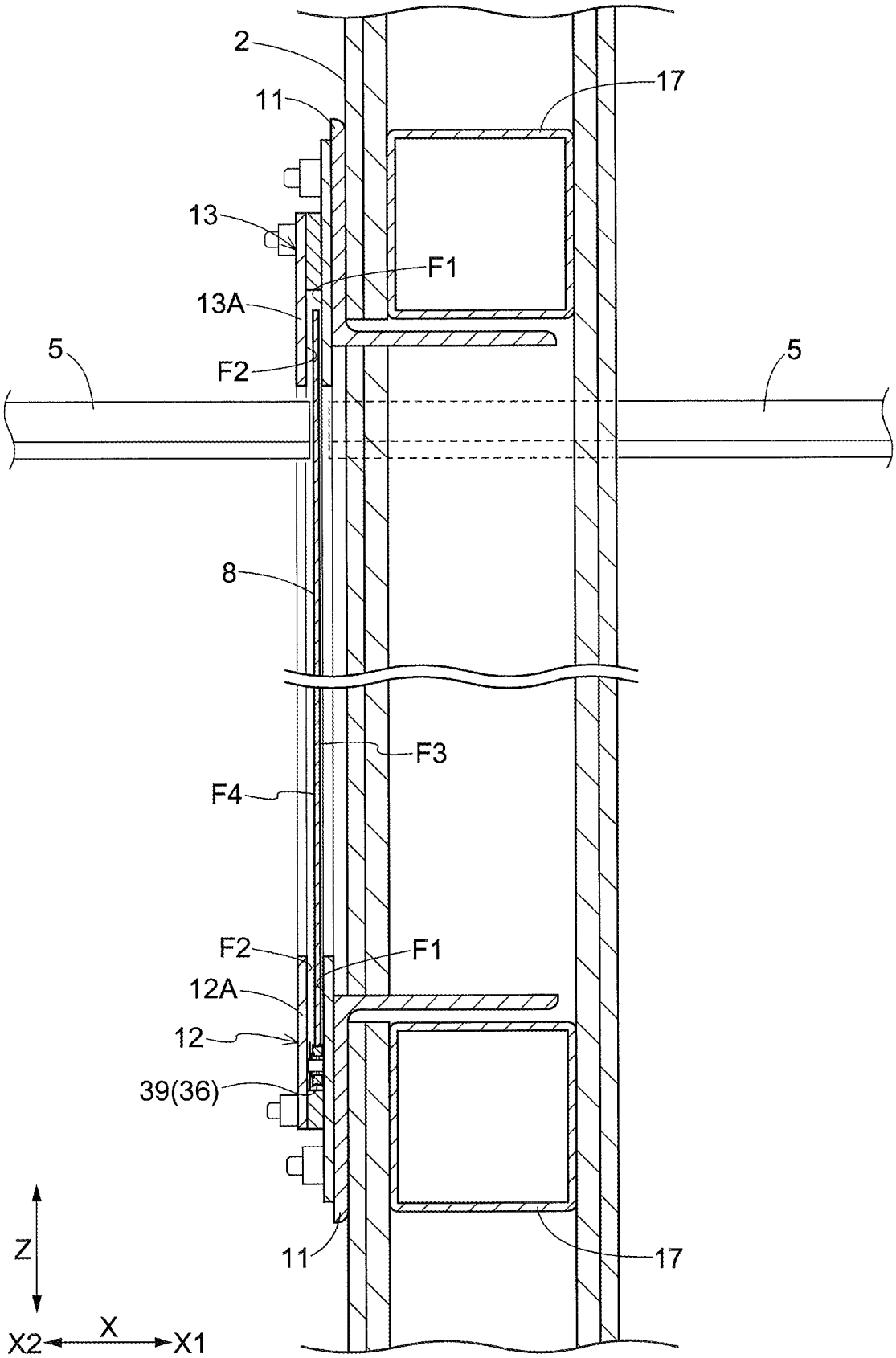
FIG. 4 is a vertical side cross-sectional view of the sliding fire door with its door main body in the opening position taken along the line IV-IV in FIG. 2.
Figure 5:
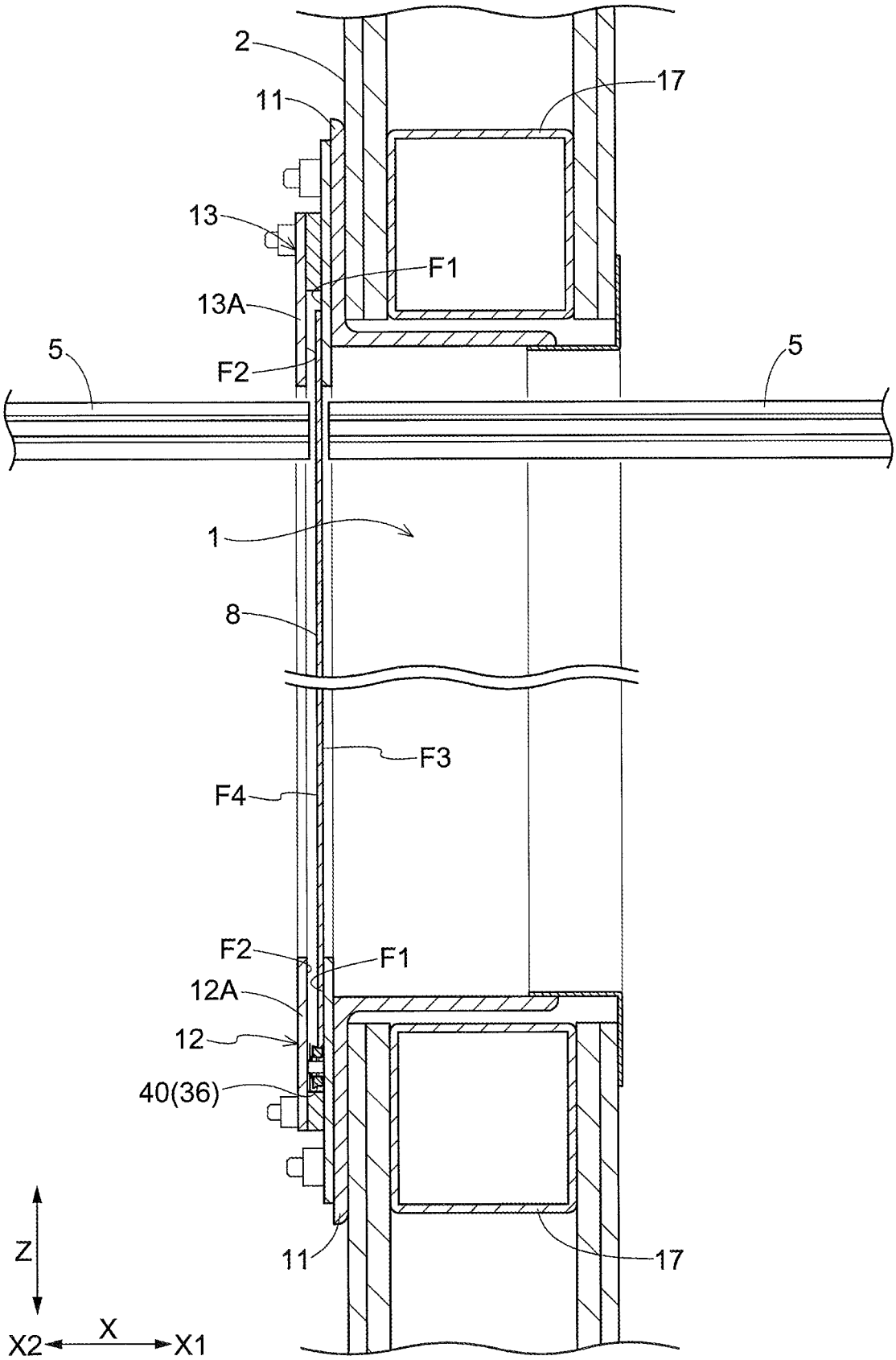
FIG. 5 is a vertical side cross-sectional view of the sliding fire door with its door main body in the closing position taken along the line V-V in FIG. 3.
Figure 13:
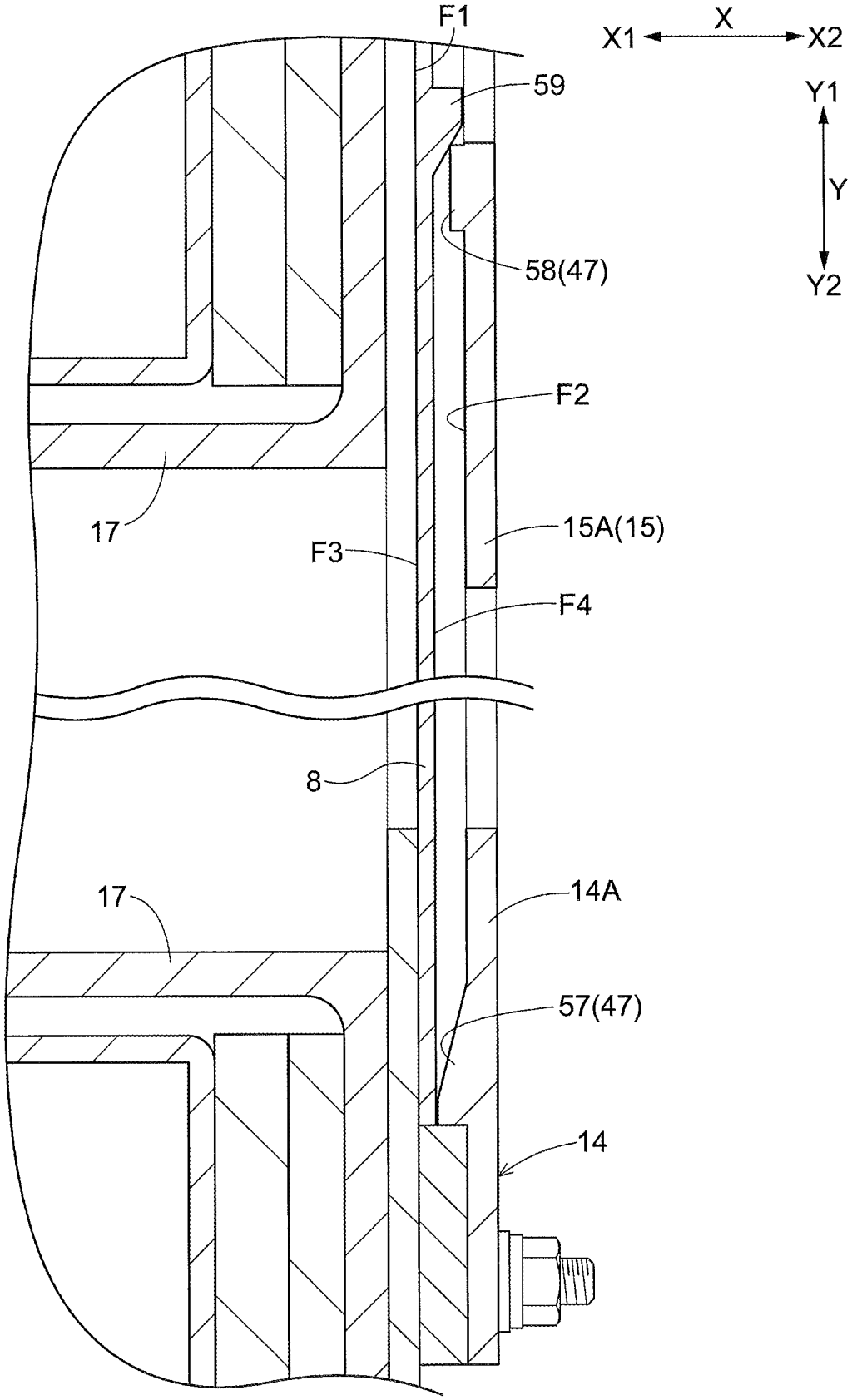
FIG. 13 is a cross-sectional plan view of the sliding fire door with its door main body in the closing position taken along the line XIII-XIII in FIG. 3.

As shown in FIGS. 4 and 5, the lower frame member 12 has a lower recessed portion 12A which is recessed downward and extending along the right and left direction Y whereas the upper frame member 13 has an upper recessed portion 13A which is recessed upward and extending along the right and left direction Y. As shown in FIG. 13, the first vertical frame member 14 has a closed-end recessed portion 14A which is recessed in or toward the second-side direction Y2 along the right and left direction Y and extending along the vertical direction Z. As shown in FIG. 1, the second vertical frame member 15 has a passage portion 15A that allows passage along the right and left direction Y.

Each of the lower recessed portions 12A, the upper recessed portion 13A, the closed-end recessed portion 14A, and the passage portion 15A has a first frame surface F1 and a second frame surface F2 which are oriented toward and face each other. The first frame surface F1 is oriented in the second-side direction X2 along the front-and-back direction X whereas the second frame surface F2 is oriented in the first-side direction X1 along the front-and-back direction X.

[Door Main Body]

As shown in FIGS. 1 through 3, the door main body 8 is arranged in such an attitude that it extends along the vertical direction Z and along the right and left direction Y. The door main body 8 is supported by the opening frame 7 such that it can be moved along the right and left direction Y. As a result of being moved along the right and left direction Y, the door main body 8 is moved to the opening position for leaving the opening 1 open (see FIGS. 1 and 2) and to the closing position (see FIG. 3) for closing the opening 1. The first door surface F3 (see FIG. 4) which is a surface of the door main body 8 that is oriented in the first-side direction X1 along the front-and-back direction X is oriented toward the wall 2.

The lower end portion of the door main body 8 is inserted in the lower recessed portion 12A. The lower end portion of the door main body 8 overlaps with the first and second frame surfaces F1, F2 of the lower recessed portion 12A as seen along the front-and-back direction X. In addition, the upper end portion of the door main body 8 is inserted in the upper recessed portion 13A. The upper end portion of the door main body 8 overlaps with the first and second frame surfaces F1, F2 of the upper recessed portion 13A as seen along the front-and-back direction X.

When the door main body 8 is in the closing position, the end portion of the door main body 8 that is on the second-side Y2 along the right and left direction Y is inserted in the closed-end recessed portion 14A, and overlaps with the first and second frame surfaces F1, F2 of the closed-end recessed portion 14A as seen along the front-and-back direction X. In addition, when the door main body 8 is in the closing position, the end portion of the door main body 8 that is on the first-side Y1 along the right and left direction Y overlaps with the first and second frame surfaces F1, F2 of the closed-end recessed portion 14A as seen along the front-and-back direction X.

Note that the first door surface F3 is, or corresponds to, the first opposing surface that is oriented toward the wall 2 in the present embodiment. In addition, the first frame surface F1 of the opening frame 7, which is the totality of the first surfaces F1 of the frame members 12, 13, 14, 15 described above, is, or corresponds to, the second opposing surface which is oriented toward the first opposing surface of the door main body 8 in the closing position in the present embodiment.

The first door surface F3 of the door main body 8 has a first overlapping portion that overlaps with the wall 2, as seen along the front-and-back direction X, when the door main body 8 is located in the closing position. This first overlapping portion is so provided to encircle the entire perimeter of the opening 1 as seen along the front-and-back direction X. In addition, the first frame surface F1 of the opening frame 7 has a second overlapping portion which overlaps with the first overlapping portion of the door main body 8 as seen along the front-and-back direction X, when the door main body 8 is located in the closing position. This second overlapping portion is so provided to encircle the entire perimeter of the opening 1 as seen along the front-and-back direction X.

A detected portion 18 is provided in an end portion, on the first-side Y1 along the right and left direction Y, of the door main body 8. This detected portion 18 is so located that it is detected by a first detector 19 when the door main body 8 is in the opening position, and is detected by a second detector 20 when the door main body 8 is in the closing position. Note that, in the present embodiment, the first detector 19 and the second detector 20 are limit switches which are triggered by a dog which functions as the detected portion 18.

In addition, an engaged member 25 is provided in an end portion, on the second-side Y2 along the right and left direction Y, of the door main body 8. As the door main body 8 is moved toward and reaches the closing position, this engaged member 25 engages the engaging member 26 to restrict the movement of the door main body 8 along the right and left direction Y. In addition, the engaged member 25 is so configured that the engaging of the engaging member 26 against the engaged member 25 can be released manually by a worker.

[Operating Mechanism]

The operating mechanism 10 includes a first operating portion 22 and a second operating portion 23. The first operating portion 22 and the second operating portion 23 are fixed to the opening frame 7.

The first operating portion 22 includes a first drum (not shown) for spooling a first wire 24 connected to an end portion, on the second-side Y2 along the right and left direction Y, of the door main body 8, and a spring (not shown) that urges the first drum in the direction for spooling the first wire 24. The first operating portion 22 works by allowing the first drum to be rotated by the urging force of the spring which causes the first wire 24 to be spooled around the first drum, which in turn causes the door main body 8 to be moved in the second-side direction Y2 along the right and left direction Y, as a result of which the door main body 8 in the opening position is moved to its closing position.

The second operating portion 23 includes a second drum (not shown) for spooling a second wire 27 connected to an end portion, on the first-side Y1 along the right and left direction Y, of the door main body 8, a manually operable and detachable handle or wheel (not shown) for rotating the second drum, and a holding mechanism (such as a one-way gear mechanism that has a ratchet wheel and a pawl) which releasably prevents the rotation of the second drum in the direction for releasing or feeding out the second wire 27 and which allows rotation of the second drum in the direction for spooling the second wire 27. The second operating portion 23 releasably prevents, by means of the holding mechanism, the door main body 8 from being moved in the second-side direction Y2 along the right and left direction Y by the urging force of the spring of the first operating portion 22. In addition, the second operating portion 23 works by allowing the door main body 8 to be moved in the first-side direction Y1 along the right and left direction Y when the second drum is rotated by a worker operating the handle or wheel to spool the second wire 27, as a result of which the door main body 8 in the closing position is moved to the opening position. Note that the second operating portion 23 may be fixedly located at a location spaced apart from the opening frame 7 when the opening frame 7 is located near the floor surface so as to make it easier for an operating worker who may be standing on the floor surface to operate. In addition, the second operating portion 23 may be of an electrically-operated type having an electric motor in place of a handle or wheel.

[Guide Rollers]

As shown in FIGS. 2 and 3, a guide roller group 31 consists of a plurality of support rollers 36 each of which can rotate about its rotation axis extending along the front-and-back direction X. And the guide roller group 31 is provided as a support roller group 37 which supports the weight of the door main body 8. The word "group" used herein simply indicates plurality and does not mean grouping. And the support roller group 37 guide the movement of the door main body 8 such that the door main body 8 can be moved along the right-and-left direction Y from the opening position in which the opening 1 is left open to the closing position in which the opening 1 is closed. Note that the support rollers 36 also function as the guide rollers configured to guide the door main body 8.

The support roller group 37 includes a plurality of opening position support rollers 39 each of which supports a portion of the weight of the door main body 8 in the opening position, and a plurality of closing position support rollers 40 each of which supports a portion of the weight of the door main body 8 in the closing position. As such, the support roller group 37 includes a plurality of support rollers 36 that function as the plurality of opening position support rollers 39 as well as a plurality of support rollers 36 that function as the plurality of closing position support rollers 40.

The plurality of closing position support rollers 40 are located to the second-side Y2 along the right-and-left direction Y with respect to the plurality of opening position support rollers 39. And the plurality of support rollers 36 which are the members of the support roller group 37 includes one or more dual-purpose support rollers 36 that support both the weight of the door main body 8 in the opening position and the weight of the door main body 8 in the closing position. In the present embodiment, one or more of the plurality of closing position support rollers 40 function as the dual-purpose support roller(s) 36.

Thus, by positioning the plurality of opening position support rollers 39 and the plurality of closing position support rollers 40 as described above, the support roller 36 that is located to the first-side Y1 along the right-and-left direction Y of, and closest to, the end portion, on the first-side Y1 along the right-and-left direction Y, of the door main body 8 (when the door main body 8 is in the closing position) is an opening position support roller 39. And the support roller 36 that is located to the second-side Y2 along the right-and-left direction Y of, and closest to, the end portion, on the first-side Y1 along the right-and-left direction Y, of the door main body 8 (when the door main body 8 is in the closing position) is a closing position support roller 40.

The opening position support rollers 39 and the closing position support rollers 40 are so installed that their rotation axes are all located at the same height.

The shape of the peripheral surfaces of the opening position support rollers 39 is different from the shape of the peripheral surfaces of the closing position support roller 40. The shape of the peripheral surfaces of the opening position support rollers 39 and the shape of the peripheral surfaces of the closing position support roller 40 are described next.

Figure 6:
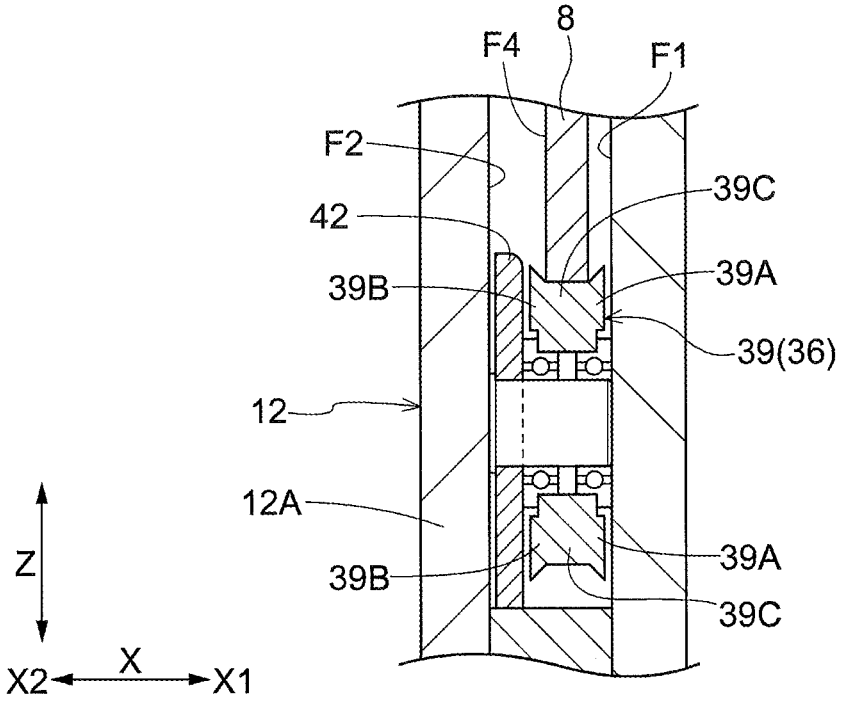
FIG. 6 is a side cross-sectional view of an opening position support roller taken along the line VI-VI in FIG. 2.

As shown in FIG. 6, each opening position support roller 39 has a third portion 39C, a first portion 39A located on the first-side X1 along the front-and-back direction X of this third portion 39C, and a second portion 39B located on the second-side X2 along the front-and-back direction X of the third portion 39C. These first portion 39A, the second portion 39B, and the third portion 39C are formed integrally to form a single piece.

The shapes of the peripheral surfaces of the first portion 39A, the second portion 39B, and the third portion 39C of each opening position support roller 39 are different from one another. The peripheral surface of the first portion 39A is a sloped surface whose radius (i.e., distance to the axis of rotation) decreases toward its end edge on the second-side X2 along the front-and-back direction X. The peripheral surface of the second portion 39B is a sloped surface whose radius decreases toward its end edge on the first-side X1 along the front-and-back direction X. The peripheral surface of the third portion 39C has the same radius regardless of the location (i.e., has a constant radius throughout its width) along the front-and-back direction X, and has the same radius as the end edge on the second-side X2 along the front-and-back direction X of the first portion 39A and as the end edge on the first-side X1 along the front-and-back direction X of the second portion 39B. The width of the third portion 39C along the front-and-back direction X is the same as, or greater than, the width of the lower end of the door main body 8 along the front-and-back direction X.

Therefore, the peripheral surface of each opening position support roller 39 is formed such that the radius of its third portion 39C, which is the intermediate portion along the front-and-back direction X (i.e., axial direction), is less than the radii of the two end portions (the first portion 39A and the second portion 39B) along the front-and-back direction X (axial direction). Thus, the door main body 8, when displaced along the front-and-back direction X from the third portion 39C, can be guided toward, and to be placed on, the third portion 39C by the first portion 39A and the second portion 39B. In addition, the door main body 8 located on the third portion 39C can be kept from being moved along the front-and-back direction X by the first portion 39A and the second portion 39B.

Figure 7:
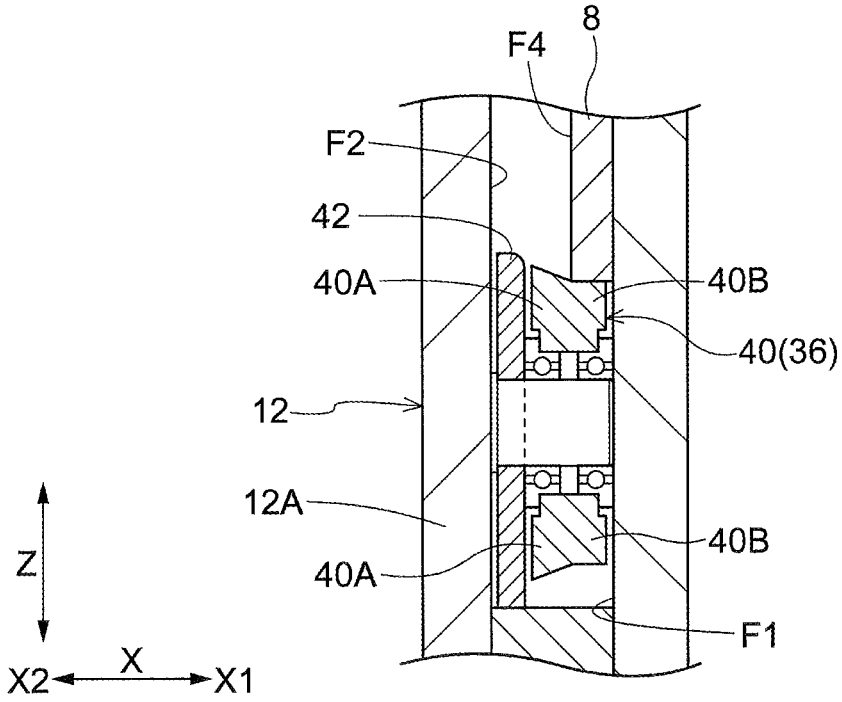
FIG. 7 is a side cross-sectional view of a closing position support roller taken along the line VII-VII in FIG. 3.

As shown in FIG. 7, each closing position support roller 40 has a fourth portion 40A, and a fifth portion 40B located on the first-side X1 along the front-and-back direction X from the fourth portion 40A. These fourth portion 40A and the fifth portion 40B are formed integrally to form a single piece.

The shapes of the peripheral surfaces of the fourth portion 40A and the fifth portion 40B of each closing position support roller 40 are different from each other. The fourth portion 40A is formed such that its radius is smaller toward its one end edge on the first-side X1 along the front-and-back direction X. In other words, the peripheral surface of the fourth portion 40A is a sloped surface slopes downward (toward the axis of rotation) toward its end edge on the first-side X1 along the front-and-back direction X. The peripheral surface of the fifth portion 40B has the same radius regardless of the location (i.e., has a constant radius throughout its width) along the front-and-back direction X, and has the same radius as the end edge on the first-side X1 along the front-and-back direction X of the fourth portion 40A. The width of the peripheral surface of the fifth portion 40B along the front-and-back direction X is less than the width of the bottom surface of the door main body 8 along the front-and-back direction X. In addition, the width from the end edge, on the second-side direction X2 along the front-and-back direction X, of the fifth portion 40B to the first frame surface F1 is less than, or equal to, the width of the bottom surface of the door main body 8 along the front-and-back direction X. Note that the width from the end edge, on the second-side direction X2 along the front-and-back direction X, of the fifth portion 40B to the first frame surface F1 may be greater than, or equal to, the width of the bottom surface of the door main body 8 along the front-and-back direction X.

Thus, at least a portion (peripheral surface of the fourth portion 40A) of the peripheral surface of each closing position support roller 40 forms a sloped surface whose radius decreases toward its end that is closer to the wall 2 (first-side X1 along the front-and-back direction X); thus, the closing position support rollers 40 also function as a displacing mechanism 32.

The radius of the peripheral surface of the third portion 39C is equal to the radius of the peripheral surface of the fifth portion 40B. In addition, the radius of the end edge, on the first-side X1 along the front-and-back direction X, of the peripheral surface of the first portion 39A, the radius of the end edge, on the second-side X2 along the front-and-back direction X, of the peripheral surface of the second portion 39B, and the radius of the end edge, on the second-side direction X2 along the front-and-back direction X, of the peripheral surface of the fourth portion 40A are equal to each other.

Thus, the radius of the end portion, on the wall 2 side (i.e., end portion closer to the wall 2), of the peripheral surface of each opening position support roller 39 (the radius of the end portion, on the first-side X1 along the front-and-back direction X, of the peripheral surface of the first portion 39A) is greater than the radius of the end portion, on the wall 2 side, of the peripheral surface of each closing position support roller 40 (the radius of the end portion, on the first-side X1 along the front-and-back direction X, of the peripheral surface of the fifth portion 40B).

Figure 8:
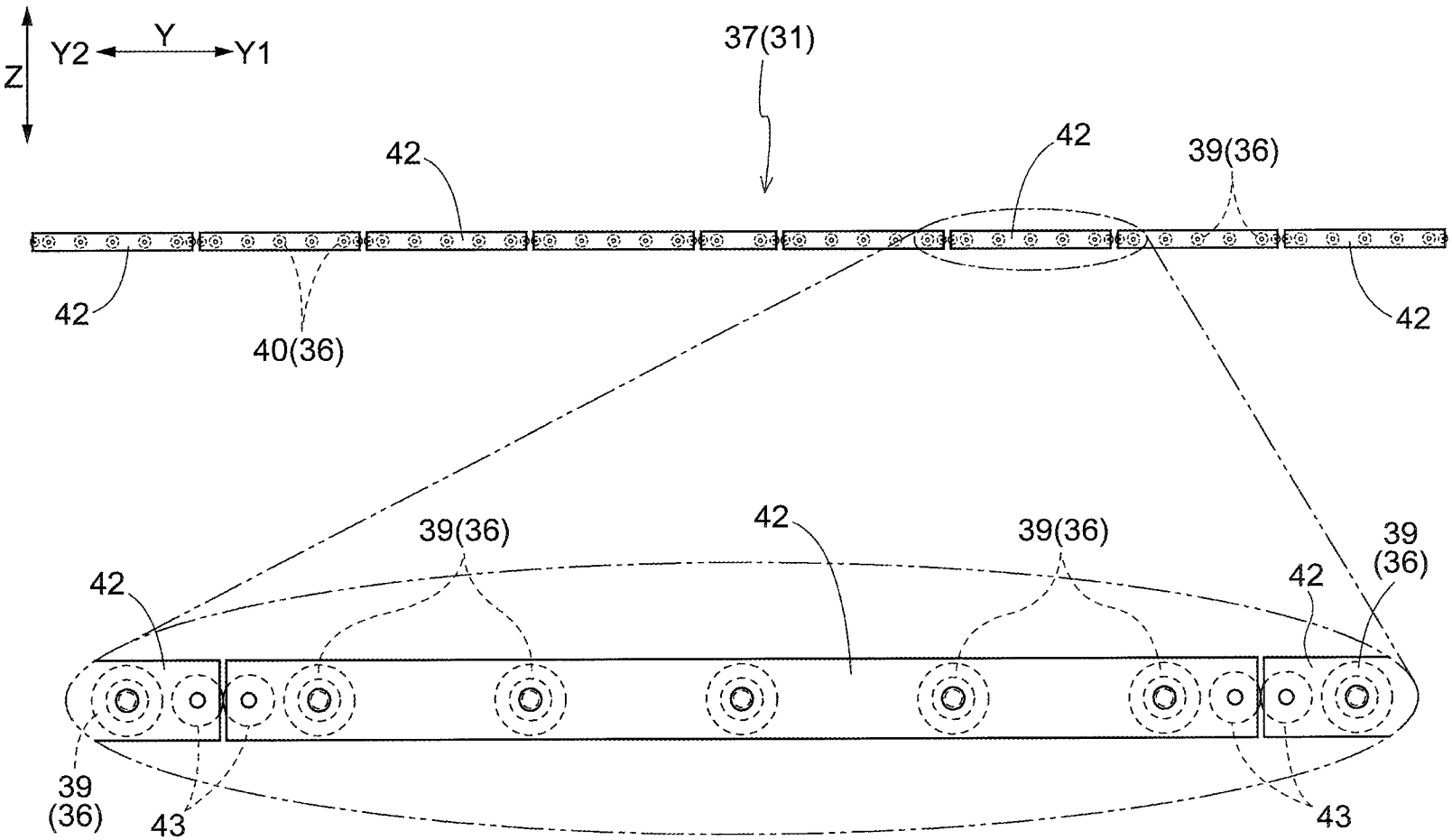
FIG. 8 is a front view of the support rollers and roller supports.

As shown in FIG. 6 and FIG. 7, each support roller 36 is supported by a roller support 42 in a cantilever fashion. More specifically, each roller support 42 is generally formed in a plate-shape (flat and thin (thickness less than length and width)) which extends along the right-and-left direction Y and along the vertical direction Z. And each support pin is supported by the corresponding roller support 42 only at one end of the support pin such that the support pin projects in the first-side direction X1 along the front-and-back direction X. Each support roller 36 is rotatably supported (through a bearing) by a support pin, and is thus supported by the corresponding roller support 42 in the cantilever fashion. As shown in FIG. 8, a plurality of support rollers 36 are arranged one adjacent to another along the right-and-left direction Y such that their axes of rotation are parallel to each other.

Note that an arrangement for supporting each support roller 36 that is different from the cantilever fashion may be adopted as appropriate and may be, among other possibilities, an intermediate-portion support arrangement in which an intermediate portion, along the front-and-back direction X, of the support roller 36 (or support pin) is supported. Or both ends of the support pin may be supported. When adopting an intermediate-portion support arrangement, a support roller 36 may be supported as follows. Specifically, each roller support 42 may support support pins in pairs with one support pin of each pair projecting in the first side direction X1 along the front-and-back direction X and the other support pin of the same pair projecting in the second side direction X2 along the front-and-back direction X. And each support roller 36 may be divided into two portions with a division made at an intermediate point along the front-and-back direction X. The two roller portions of each support roller 36 may be then rotatably supported by a corresponding pair of support pins with one roller portion projecting in the first side direction X1 along the front-and-back direction X and the other roller portion projecting in the second side direction X2 along the front-and-back direction X, with respect to the corresponding roller support 42. Also, when an arrangement in which both ends of each support pin are supported is adopted, each support roller 36 may be supported as follows. A pair of plate-shape (flat and thin (thickness less than length and width)) portions each extending along the right-and-left direction Y and along the vertical direction Z may be formed by forming each roller support 42 such that its cross vertical section is in a shape of a bracket that opens upward or of a U with two right angle corners, as seen along the right-and-left direction Y. And each end of a support pin may be supported by the corresponding one of the pair of the plate-shape portions of a roller support 42. And each support roller 36 may be supported by the corresponding support pin with the support roller 36 located between the pair of plate-shape portions.

In the present embodiment, each roller support 42 rotatably supports support rollers 36 with each such support roller 36 located to the first-side X1 along the front-and-back direction X with respect to the roller support 42. The plurality of support rollers 36 that form the support roller group 37 are distributed among, and supported by, a plurality of roller supports 42. Although the length of each roller support 42 along the right-and-left direction Y may be arbitrarily selected as desired, the length of each roller support 42 along the right-and-left direction Y in the present invention is preferably about one tenth (1/10) of the length of the opening frame 7 along the right-and-left direction Y. More specifically, the length of each roller support 42 along the right-and-left direction Y in the present invention is preferably less than or equal to 300 mm.

As shown in FIG. 8, each roller support 42 includes two restricting members 43 with one restricting member 42 provided in the end portion, on the first-side Y1 along the right-and-left direction Y, of the roller support 42, and the other in the end portion, on the second-side Y2 along the right-and-left direction Y, of the roller support 42. Each of the pair of restricting members 43 is rotatably supported by a roller support 42 for rotation about a rotation axis that extends along the front-and-back direction X. Note that the restricting members 43 may be provided only when necessary. For example, when a roller support 42 is formed such that its cross section has a shape of a bracket that opens upward or of a U with two right angle corners, as seen along the right-and-left direction Y, then the restricting members 43 may not be required depending on the shape of the roller support 42.

The restricting member 43 provided in the end portion, on the first-side Y1 along the right-and-left direction Y, of each roller support 42 has an arc-shaped portion that projects or, juts out, in the first-side direction Y1 along the right-and-left direction Y from the roller support 42. In addition, the restricting member 43 provided in the end portion, on the first-side Y1 along the right-and-left direction Y, of each roller support 42 has an arc-shaped portion that projects or, juts out, in the second-side direction Y2 along the right-and-left direction Y from the roller support 42.

As shown in FIGS. 6 and 7, each of the plurality of roller supports 42 is inserted from above into, and fit within, the lower recessed portion 12A so that the movement of each roller support 42 along the front-and-back direction X is restricted by the first frame surface F1 and the second frame surface F2. In addition, the plurality of roller supports 42 are arranged end-to-end in a line extending along the right-and-left direction Y. And the movement of each roller support 42 along the right-and-left direction Y is restricted by the end portion of the other adjacent roller support 42 or by a wall located at each end of the lower recessed portion 12A along the right-and-left direction Y. The roller supports 42 may be fixed to the lower frame member 12 with any fasteners, such as bolts and nuts, with the roller supports 42 located within the lower recessed portion 12A. In addition, one or more pressing members (such as a leaf spring or any other resilient member) may be interposed between each roller support 42 and the second frame surface F2 such that each roller support 42 is fixed to the lower frame member 12 with the roller support 42 being pressed in the first-side direction X1 along the front-and-back direction X by this pressing member.

With the restricting members 43 supported by each roller support 42 as described above, as shown in FIG. 8, roller supports 42 that are adjacent each other along the right-and-left direction Y can be prevented from directly contacting each other. And restricting members 43 that are adjacent each other along the right-and-left direction Y are in a point-contact (i.e., contact at a point), something close to a point-contact, with each other. This arrangement facilitates removal (upward from the lower recess portion 12A) of a roller support 42 in the middle among a plurality (three or more) of roller supports 42 that are arranged one adjacent to another (i.e., a roller support 42 with a roller support 42 located on one side and another roller support 42 located on the other side, along the right-and-left direction Y).

[Displacing Mechanism]

When the door main body 8 is moved from the opening position to the closing position, the displacing mechanisms 32 move, or displace, the door main body 8 in the direction (first-side direction X1 along the front-and-back direction X) that causes the first door surface F3 of the door main body 8 to be moved closer to the first frame surface F1 of the opening frame 7. In the present embodiment, in addition to the closing position support rollers 40 described above, movable members 46 (see FIGS. 9 and 10) which are moved (more specifically rotated) by the door main body 8 that is being moved toward the closing position, and a stationary member 47 (see FIG. 13) which is fixedly provided are provided as displacing mechanisms 32.

As shown in FIGS. 9 through 12, each movable member 46 has a moved portion 51 which is pushed and moved by the door main body 8 as the door main body 8 is moved to the closing position, a pressing portion 52 configured to press or push the door main body 8 in the first-side direction X1 along the front-and-back direction X as the moved portion 51 is moved, a connecting portion 53 which connects the moved portion 51 and the pressing portion 52 to each other, and a rotatably supporting portion 54 which supports the connecting portion 53 for rotation with respect to the wall 2.

The moved portion 51 is connected to a first portion 53A of the connecting portion 53 that is on one side of the rotatably supporting portion 54 whereas the pressing portion 52 is connected to a second portion 53B of the connecting portion 53 that is on the other side of the rotatably supporting portion 54. Note that the moved portion 51, the pressing portion 52, the connecting portion 53, and the rotatably supporting portion 54 are formed integrally to form a single piece.

The connecting portion 53 is formed to have a shape that is bent so that the first portion 53A extends along a direction that intersects the direction along which the second portion 53B extends, as seen along the front-and-back direction X (an "opposing direction" which is defined to be a direction perpendicular or normal to the first opposing surface).

The moved portion 51 is pushed and moved by the door main body 8 as the door main body 8 is moved toward the closing position. The pressing portion 52 has a pressing surface which is caused to contact the second door surface F4 from the second-side X2 along the front-and-back direction X by the pivoting movement of the movable member 46 with the rotatably supporting portion 54 located in an area of the center of the pivoting movement that accompanies the movement of the moved portion 51. This pressing surface is a sloped surface which is sloped along a direction of the pivoting movement of the movable member 46 when the movable member 46 (moved portion 51) is pushed by the door main body 8. This pressing surface is sloped such that, when the movable member 46 (moved portion 51) is in a rotational position after it has been pushed by the door main body 8 (position or attitude shown with solid lines in FIGS. 9 and 10), the surface is spaced farther from the wall 2 toward the edge, on the second-side direction Y2 along the right-and-left direction Y, of the second door surface F4. Note that, as shown in FIG. 13, the surface of the door main body 8 that is on the opposite side from the first door surface F3 of the door main body 8 is referred to as the second door surface F4 (which corresponds to the non-opposing surface).

A first movable member 48 and a second movable member 49 are provided as the movable members 46. The first movable member 48 and the second movable member 49 are described in further detail next.

Figure 10:
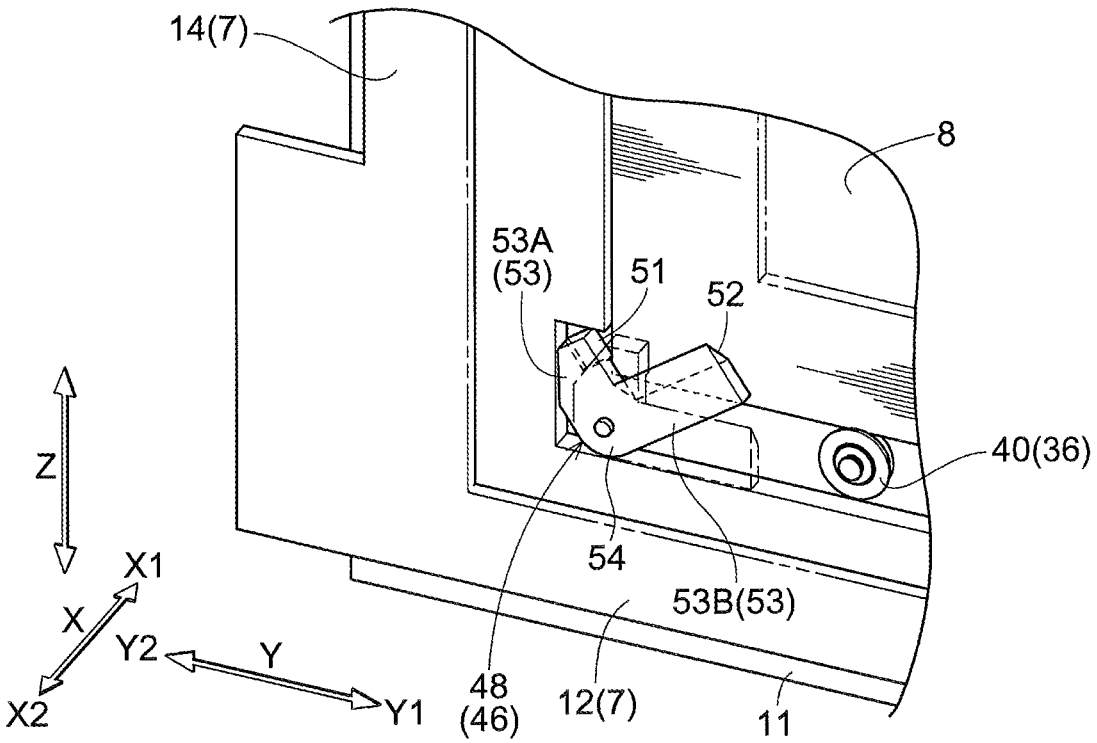
FIG. 10 is a perspective view of a first movable member, FIG. 11 provides a front view and a side view of a second movable member, FIG. 12 provides a front view and a side view of a second movable member.
Figure 11:
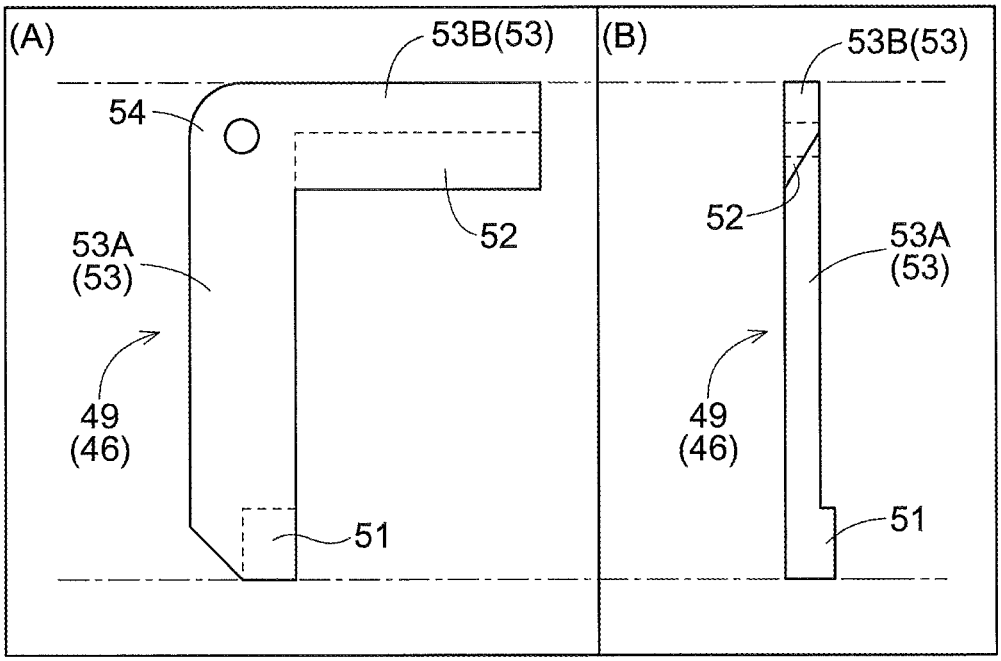
Figure 12:
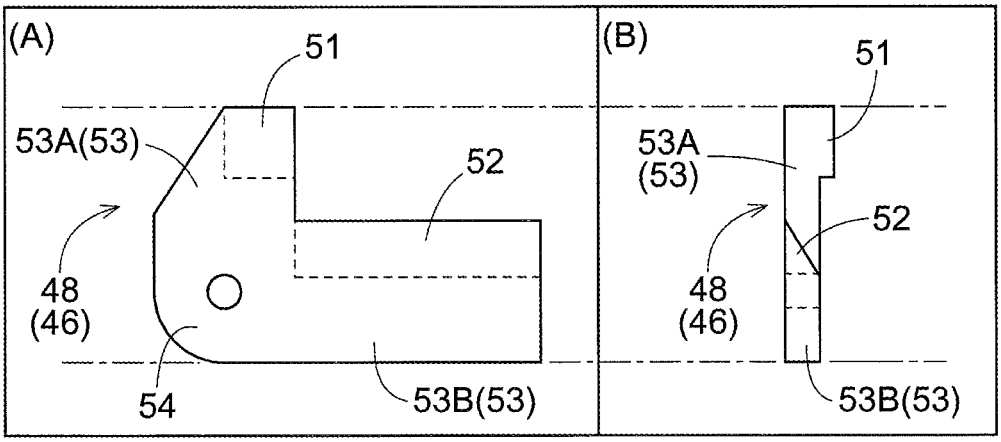

As shown with dashed-lines in FIG. 10, the first movable member 48 is positioned such that, when the first movable member 48 has not been pushed by the door main body 8, the first portion 53A extends upward from the rotatably supporting portion 54 while the second portion 53B extends in the first-side direction Y1 along the right-and-left direction Y from the rotatably supporting portion 54. In addition, the first movable member 48 is located in a lower end portion of the first vertical frame member 14, and is pivotable about an axis that extends along the front-and-back direction X. In addition, the first movable member 48 is located to the second-side Y2 along the right-and-left direction Y of, and at a lower position than, the door main body 8 in the closing position. And the first portion 53A is located to the second-side Y2 along the right-and-left direction Y of, or with respect to, the door main body 8 while the pressing surface of the second portion 53B is located below the lower end or edge of the door main body 8. And the first movable member 48 is pivoted with the rotatably supporting portion 54 generally located in a center of rotation as shown with solid lines in FIG. 10 as a result of the moved portion 51 being pushed by the end or edge portion, on the second-side direction Y2 along the right-and-left direction Y, of the door main body 8 as the door main body 8 is moved to the closing position. As a result of the first movable member 48 being pivoted in this way, the pressing portion 52 is inserted into a space between the second door surface F4 of the door main body 8 and the second frame surface F2 of the opening frame 7. And the door main body 8 is pushed in the first-side direction X1 along the front-and-back direction X by the pressing surface of the pressing portion 52.

Figure 9:
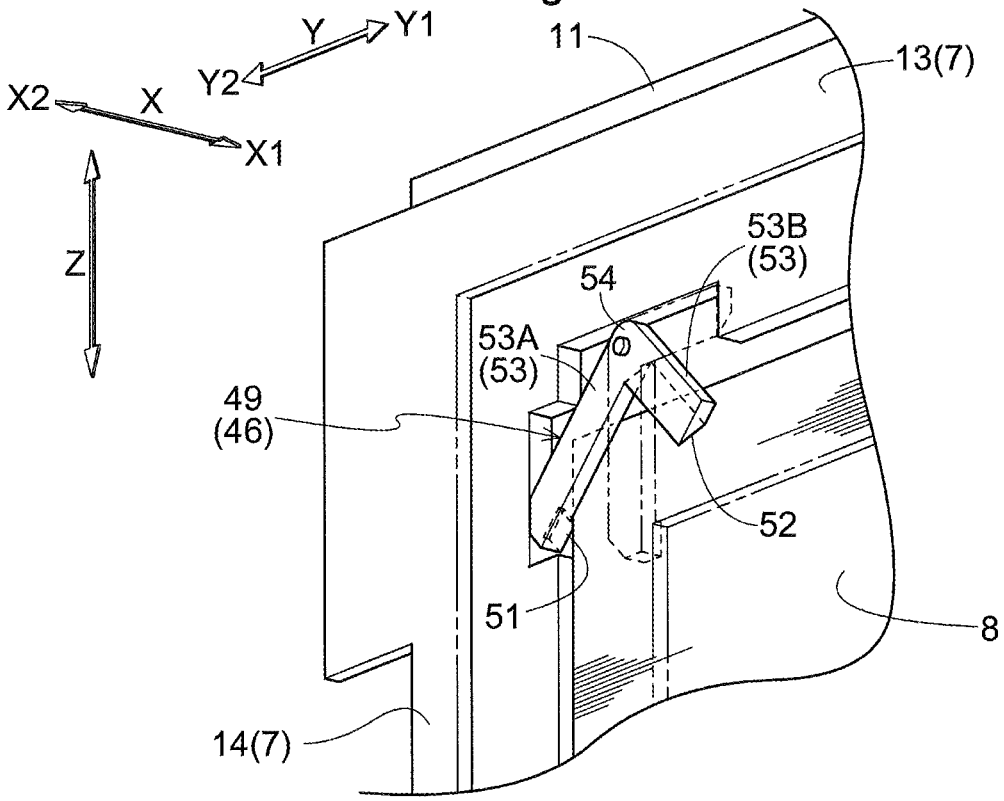
FIG. 9 is a perspective view of a second movable member.

As shown with dashed-lines in FIG. 9, the second movable member 49 is positioned such that, when the second movable member 49 has not been pushed by the door main body 8, the first portion 53A extends downward while the second portion 53B extends in the first-side direction Y1 along the right-and-left direction Y. In addition, the second movable member 49 is located in an upper end portion of the first vertical frame member 14, and is pivotable about an axis that extends along the front-and-back direction X. In addition, the second movable member 49 is located to the second-side Y2 along the right-and-left direction Y of, and at a higher position than, the door main body 8 in the closing position. And the first portion 53A is located to the second-side Y2 along the right-and-left direction Y of, or with respect to, the door main body 8 while the pressing surface of the second portion 53B is located above the upper end or edge of the door main body 8. And the second movable member 49 is pivoted with the rotatably supporting portion 54 located in an area of a center of rotation as shown with solid lines in FIG. 9 as a result of the moved portion 51 being pushed by the end or edge portion, on the second-side direction Y2 along the right-and-left direction Y, of the door main body 8 when the door main body 8 is moved to the closing position. As a result of the second movable member 49 being pivoted in this way, the pressing portion 52 is inserted into a space between the second door surface F4 of the door main body 8 and the second frame surface F2 of the opening frame 7. And the door main body 8 is pushed in the first-side direction X1 along the front-and-back direction X by the pressing surface of the pressing portion 52.

As shown in FIG. 13, the stationary member 47 has one or more first stationary portions 57 located in the closed-end recessed portion 14A of the first vertical frame member 14 and one or more second stationary portions 58 located in the passage portion 15A of the second vertical frame member 15. The one or more first stationary portions 57 are provided on the portion of the first vertical frame member 14 that faces the door main body 8 along the front-and-back direction X so as to extend continuously (in case one first stationary portion 57 is provided), or alternatively, be spaced apart from each other (in case more than one first stationary portions 57 are provided), along the vertical direction Z. The one or more second stationary portions 58 are provided on the portion of the second vertical frame member 15 that faces the door main body 8 along the front-and-back direction X so as to extend continuously (in case one second stationary portion 58 is provided), or alternatively, be spaced apart from each other (in case more than one second stationary portions 58 are provided), along the vertical direction Z. The surface of each of one or more first stationary portions 57 that is on the first-side X1 along the front-and-back direction X is formed as a sloped surface that is sloped such that it is closer to the first frame surface F1 toward its second-side Y2 end along the right-and-left direction Y.

In addition, formed on an end portion, on the first-side Y1 along the right-and-left direction Y, of the door main body 8 are one or more projections 59, each of which projects in the second-side direction X2 along the front-and-back direction X, and which extend continuously (in case one projection 59 is provided) or alternatively are spaced apart from each other (in case more than one projections 59 are provided), along the vertical direction. The surface of each of one or more projections 59 that is on the second-side Y2 along the right-and-left direction Y is formed as a sloped surface that is sloped such that it is farther away from the first frame surface F1 toward its first-side Y1 end along the right-and-left direction Y.

When the door main body 8 is moved toward the closing position, the end portion, on the second-side Y2 along the right-and-left direction Y, of the door main body 8 is guided, moved, and displaced, by the one or more first stationary portions 57 in the first-side direction X1 along the front-and-back direction X whereas the one or more projections 59 of the door main body 8 is guided, moved, and displaced, by the one or more second stationary portions 58 in the first-side direction X1 along the front-and-back direction X.

While detailed description is omitted here, the article transport facility is provided with a controller (not shown) which controls one or more ceiling or overhead transport vehicles as well as the sliding fire door 3. The controller keeps track of the position of the door main body 8 based on the detected information from the first detector 19 and the second detector 20, and causes the ceiling transport vehicle to be stopped before it reaches the sliding fire door 3 if the door main body 8 is not in the opening position. And the controller controls the second operating portion 23 based on a fire information from a fire alarm to release and allow the second drum to commence rotation which is prevented by the holding mechanism of the second operating portion 23. This allows the door main body 8 to be moved from the opening position to the closing position under the urging force of the spring of the first operating portion 22.

2. Other Embodiments

Other embodiments of a sliding fire door are described next.

Figure 14:
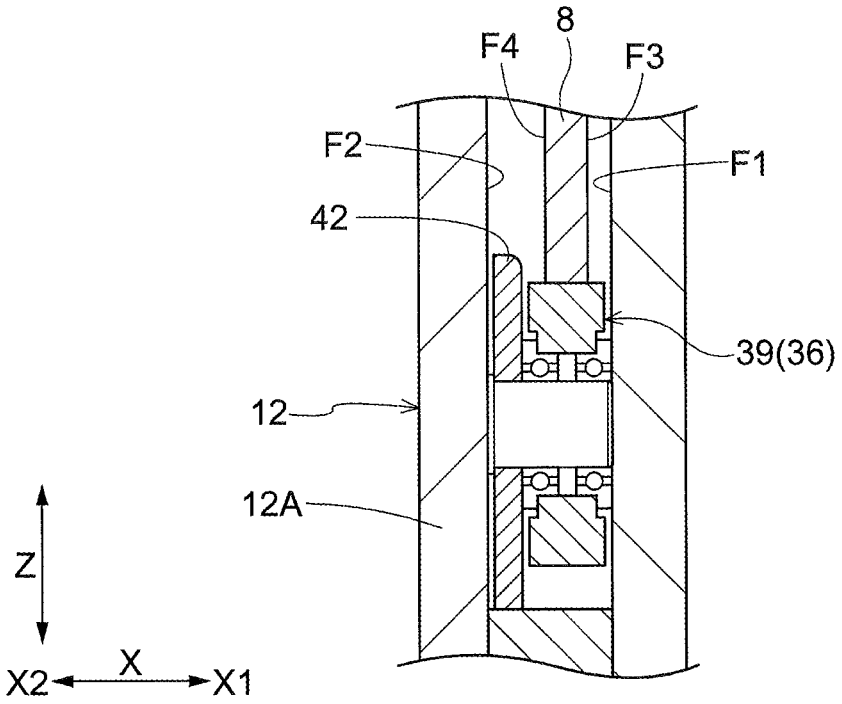
FIG. 14 is a side cross-sectional view of an opening position support roller in accordance with an alternative embodiment (1) taken along the line VI-VI in FIG. 2.

(1) In the embodiment described above, each opening position support roller 39 has the first portion 39A, the second portion 39B, and the third portion 39C whose peripheral surfaces have different shapes such that the peripheral surface of the opening position support roller 39 is recessed downward (i.e. toward the axis of rotation) in the middle portion along the front-and-back direction X. However, the shape of the peripheral surface of each opening position support roller 39 may be changed suitably. More specifically, as shown in FIG. 14, the peripheral surface of an opening position support roller 39 may have a shape whose radius is constant throughout its width along the front-and-back direction X.

Figure 15:
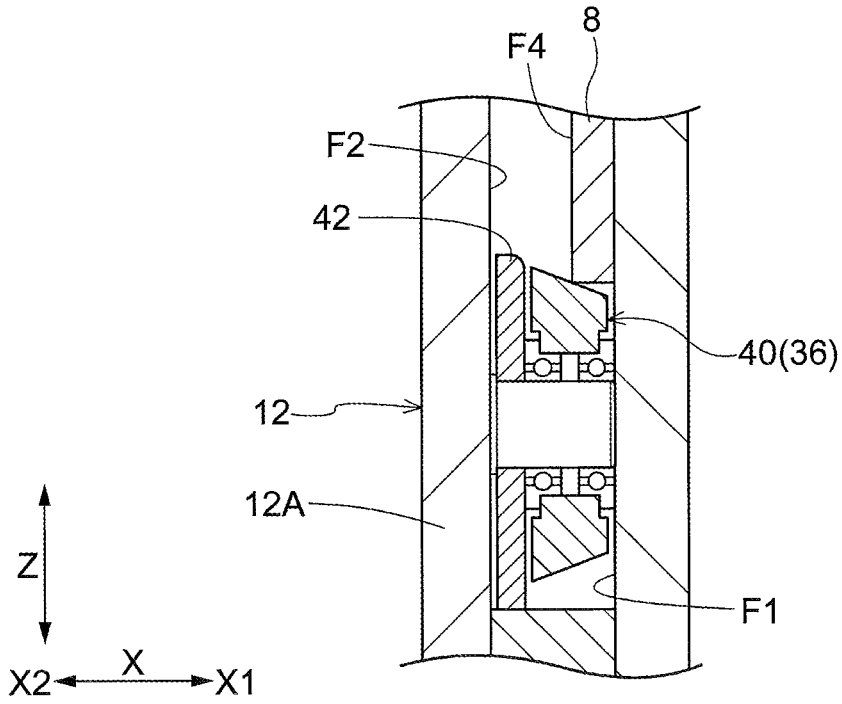
FIG. 15 is a side cross-sectional view of a closing position support roller in accordance with an alternative embodiment (2) taken along the line VII-VII in FIG. 3.

(2) In the embodiment described above, each closing position support roller 40 has the fourth portion 40A and the fifth portion 40B whose peripheral surfaces have different shapes. And only a portion of the peripheral surface of the closing position support roller 40 is a sloped surface whose radius decreases toward its end on the first side X1 along the front-and-back direction X. However, the shape of the peripheral surface of each closing position support roller 40 may be changed suitably. More specifically, as shown in FIG. 15, the entire peripheral surface of the closing position support roller 40 may be formed as a sloped surface whose radius decreases toward its end on the first-side X1 along the front-and-back direction X.

Figure 16:
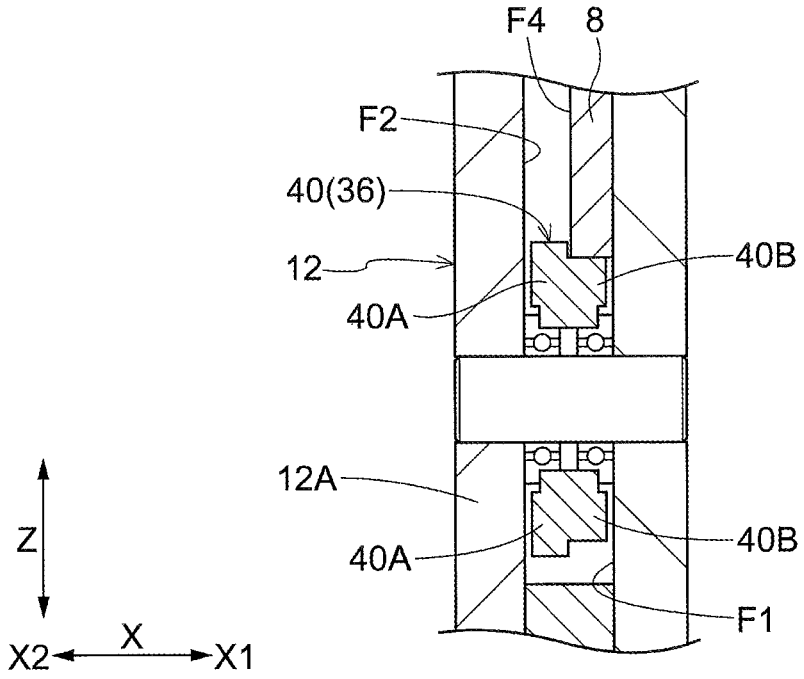
FIG. 16 is a side cross-sectional view of a closing position support roller in accordance with an alternative embodiment (3) taken along the line VII-VII in FIG. 3.

(3) In the embodiment described above, the closing position support rollers 40 also function as a displacing mechanism 32. However, the closing position support rollers 40 do not need to function as a displacing mechanism 32. More specifically, as shown in FIG. 16, each of the fourth portion 40A and the fifth portion 40B of the closing position support roller 40 may have a shape whose radius is constant throughout the its width along the front-and-back direction X and may be such that the fourth portion 40A is formed to have a greater radius than the radius of the fifth portion 40B. Although the closing position support rollers 40 do not function as a displacing mechanism 32 if and when the closing position support rollers 40 are formed to have such a shape, the door main body 8 which has been moved in the first-side direction X1 along the front-and-back direction X and is supported by the fifth portion 40B can be prevented from moving in the second-side direction X2 along the front-and-back direction X by the fourth portion 40A.

Figure 17:
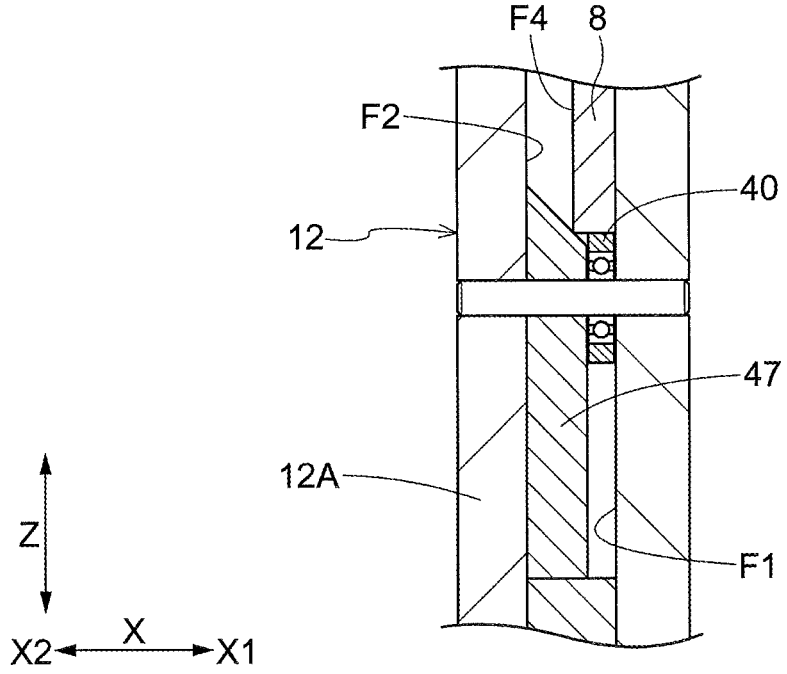
FIG. 17 is a side cross-sectional view of a closing position support roller in accordance with an alternative embodiment (4) taken along the line VII-VII in FIG. 3.
Figure 18:
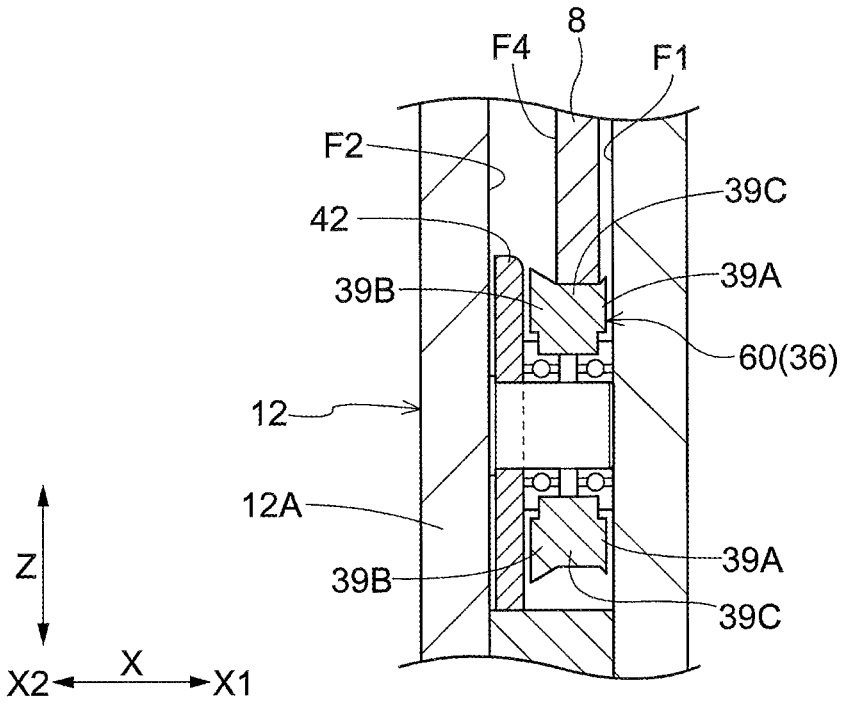
FIG. 18 is a side cross-sectional view of a relay support roller in accordance with an alternative embodiment (5) taken along the line VI-VI in FIG. 2.

(4) In the embodiment described above, one or more stationary members 47 are located at locations at which the one or more stationary members 47 do not overlap with the closing position support rollers 40 as seen along the front-and-back direction X. However, the one or more stationary members 47 may be located at locations at which the one or more stationary members 47 overlap with the closing position support rollers 40 as seen along the front-and-back direction X. More specifically, as shown in FIG. 17, the peripheral surface of a closing position support roller 40 may be formed to have a shape whose radius is constant throughout its width along the front-and-back direction X. And the width of the closing position support roller 40 along the front-and-back direction X may be narrower than the width of the door main body 8 along the front-and-back direction X. And a stationary member 47 may be located on the second-side X2 along the front-and-back direction X of the closing position support roller 40 and at such a position as to overlaps with the closing position support roller 40 as seen along the front-and-back direction X. And the stationary member 47 becomes capable of moving the door main body 8 on the sloped surface in the first-side direction X1 along the front-and-back direction X by forming the top surface of this stationary member 47 as a sloped surface which is sloped downward toward its end on the first side X1 along the front-and-back direction, (5) In the embodiment described above, one or more of the plurality of closing position support rollers 40 serve as the dual-purpose support roller(s) 36 which support both the weight of the door main body 8 in the opening position and the weight of the door main body 8 in the closing position. However, one or more of the plurality of opening position support rollers 39 may function as such dual-purpose support roller(s) 36. In addition, one or more dual-purpose support rollers 36 may be, one or more relay support rollers 60 (such as one shown in FIG. 18) which have a peripheral surface of a shape that is intermediate between the shape of the peripheral surfaces of the opening position support rollers 39 and the shape of the peripheral surfaces of the closing position support rollers 40. Note that one or more support rollers 36 of the support roller group 37 that are not dual-purpose support rollers 36 may be formed to be such relay support rollers 60.

(6) In the embodiment described above, the guide roller group 31 consists of the support roller group 37. However, the guide roller group 31 may consist of a restricting roller group (provided in addition to the support roller group 37) whose each roller is rotatable about a rotation axis that extends along the vertical direction Z and is in contact with a surface of the door main body 8 that is oriented along the front-and-back direction X. Furthermore, the guide roller group 31 may consist of a support roller group 37 and a restricting roller group.

(7) In the embodiment described above, the door main body 8 is moved to the opening position and to the closing position by moving the door main body 8 along the right-and-left direction Y. However, the door main body 8 may be moved to the opening position and to the closing position by moving the door main body 8 along the vertical direction Z.

In addition, in the embodiment described above, the door main body 8 is arranged (with respect to the opening 1 which extends through the wall 2 along the front-and-back direction X) in such an attitude that the door main body 8 extends along the vertical direction Z and along the right-and-left direction Y. However, the door main body 8 may be arranged (with respect to the opening 1 which extends through the wall 2 along the vertical direction Z) in such an attitude that the door main body 8 extends along the front-and-back direction X and along the right-and-left direction Y such that the door main body 8 may be moved to the opening position and to the closing position by moving the door main body 8 along the right-and-left direction Y, or along the front-and-back direction X.

(8) In the embodiment described above, the rotation axis of each opening position support roller 39 and the rotation axis of each closing position support roller 40 are at the same height. However, the height of the rotation axis of each opening position support roller 39 may be different from the height of the rotation axis of each closing position support roller 40. More specifically, for example, the rotation axis of each opening position support roller 39 may be at a greater height than the rotation axis of each closing position support roller 40. Thus, by so locating the opening position support rollers 39 and the closing position support rollers 40, the height at which the door main body 8 is supported by the opening position support rollers 39 is lower than the height at which the door main body 8 is supported by the closing position support rollers 40, which makes it easier for the door main body 8 to be moved from the opening position to the closing position while making it more difficult for the door main body 8 to be moved from the closing position to the opening position.

(9) In the embodiment described above, the closing position support rollers 40, the movable members 46, and the stationary member 47 are provided as the displacing mechanisms 32. However, it suffices if at least one of (a) the closing position support rollers 40, (b) the movable members 46, and (c) the stationary member 47 is/are provided as the displacing mechanism(s) 32.

(10) Note that an arrangement disclosed in any of the embodiments described above can also be used in combination with any arrangement disclosed in any other embodiment unless inconsistency arises. Regarding any other arrangements and features, the embodiments disclosed in the present description are provided for the purposes of illustration only regarding all aspects. Therefore, it is possible to make various suitable changes without departing from the spirit of the present disclosure.

3. Summary of Embodiments Described Above

A brief summary of some of the features of the sliding fire door described above is provided next.

A sliding fire door provided to a wall which has an opening formed therein, the sliding fire door comprises: an opening frame at least a portion of which frames the opening; a fire door configured to leave open and close the opening; a guiding mechanism configured to guide the door main body along a slide direction parallel to the wall; wherein the guiding mechanism includes a guide roller group which includes a plurality of guide rollers arranged one adjacent to another along the slide direction and which is configured to guide the door main body, wherein the guiding mechanism is configured to guide the door main body such that the door main body is allowed to be moved along the slide direction from an opening position for leaving open the opening to a closing position for closing the opening, wherein the door main body has a first opposing surface which is oriented toward the wall, wherein the opening frame has a second opposing surface which is oriented toward the first opposing surface of the door main body in the closing position, and wherein the guiding mechanism includes at least one displacing mechanism configured to move the door main body in such a direction as to cause the first opposing surface to be moved closer to the second opposing surface, when the door main body is moved from the opening position to the closing position.

With such an arrangement, since the door main body is guided by the plurality of guide rollers arranged one adjacent to another along the slide direction, the door main body can be smoothly moved from the opening position to the closing position. By so providing the plurality of guide rollers arranged one adjacent to another along the slide direction to guide the door main body with the plurality of guide rollers, it becomes unnecessary to install any rails extending along the slide direction as with the case where rollers are provided to the door main body. Thus, the cost of the sliding fire door can be reduced.

And when the door main body is moved from the opening position to the closing position, the door main body is moved in such a direction as to cause the first opposing surface of the door main body to be moved closer to the second opposing surface of the opening frame. This can eliminate or reduce the gap between the door main body and the opening frame; thus, the opening can be closed more tightly by the door main body.

As such, the arrangement described above makes it easier to improve tightness of the closure of the opening by the door main body while reducing any increase in its manufacturing cost.

Here, the slide direction is preferably a horizontal direction, wherein the door main body is preferably arranged in such an attitude that the door main body extends along a vertical direction and along the slide direction, wherein the guide roller group preferably includes a support roller group consisting of a plurality of support rollers each of which supports a portion of a weight of the door main body with a peripheral surface that surrounds an axis of rotation, wherein the support roller group preferably includes one or more opening position support rollers each of which supports a portion of the weight of the door main body when the door main body is in the opening position, and one or more closing position support rollers each of which supports a portion of the weight of the door main body when the door main body is in the closing position, wherein a shape of a peripheral surface or peripheral surfaces of the one or more opening position support rollers is preferably different from a shape of a peripheral surface or peripheral surfaces of the one or more closing position support rollers, wherein at least a portion of the peripheral surface of each of the one or more closing position support rollers is preferably a sloped surface whose radius decreases toward an end thereof that is closer to the wall, and wherein the one or more closing position support rollers preferably function as one of the at least one displacing mechanism.

With such an arrangement, the door main body located in the closing position is supported by the one or more closing position support rollers. And because at least a portion of the peripheral surface of each closing position support roller is a sloped surface, the door main body supported by the one or more closing position support rollers would slide down the sloped surface or surfaces toward the wall, which causes first opposing surface to be moved closer to the second opposing surface.

The one or more closing position support rollers so configured function also as a displacing mechanism. Thus, it is not necessary to provide separately any other mechanism for moving the first opposing surface in the direction that causes the first opposing surface to be moved closer the second opposing surface. Therefore, the structure of the sliding fire door can be simplified compared with a case in which an additional displacing mechanism is separately provided, thus, making it easier to reduce cost of the sliding fire door.

In addition, a radius of an end portion, on a side closer to the wall, of the peripheral surface of each of the one or more opening position support rollers is preferably greater than a radius of an end portion, on a side closer to the wall, of the peripheral surface of each of the one or more closing position support rollers, wherein, one of the plurality of support rollers that is located to an open position side of, and closest to, a rearward end, along the slide direction, of the door main body when the door main body is in the closing position, is preferably one of the one or more opening position support rollers.

With such an arrangement, when the door main body is in the closing position and is located close to the wall, the door main body is supported by the one or more closing position support rollers where the radius is less than that of a portion of each of the one or more opening position support rollers.

And one of the plurality of support rollers that is located to an open position side of, and closest to, a rearward end, along the slide direction, of the door main body when the door main body is in the closing position, is an opening position support roller with a portion having a relatively large radius. Thus, in order for the door main body to be moved from the closing position toward the opening position, the door main body needs be moved from the smaller radius portions of the one or more closing position support rollers and to ride over the relatively large radius portion of the opening position support roller. This arrangement makes it difficult for the door main body (after it has been moved to and is in the closing position) to return to the opening position.

Also, one or more relay support rollers, each of which has a peripheral surface of a shape that is intermediate between the shape of the peripheral surface of each of the one or more opening position support rollers and the shape of the peripheral surface of each of the one or more closing position support rollers, are preferably located between the one or more opening position support rollers on one hand and the one or more closing position support rollers on the other hand along the slide direction.

With such an arrangement, when moving the door main body from the opening position to the closing position, the door main body travels over the one or more opening position support rollers, the one or more relay support rollers, and the one or more closing position support rollers sequentially in that order. And the peripheral surface of each of one or more relay support rollers, which are located between the one or more opening position support rollers and the one or more closing position support rollers, has a shape that is intermediate between the shapes of these two types of support rollers. Thus, the door main body can be moved more smoothly when moving it from the opening position to the closing position compared with a case where the door main body is moved from the one or more opening position support rollers directly to the one or more closing position support rollers.

In addition, the peripheral surface of each of the one or more opening position support rollers is preferably formed such that a radius of an intermediate portion of the peripheral surface along an axial direction is less than a radius or radii of two end portions, along the axial direction, of the peripheral surface.

With such an arrangement, when the door main body is supported by the intermediate portion or portions of the one or more opening position support rollers, it is made difficult for the door main body to be (or the door can be prevented from being) moved closer to, or away from, the wall because of the presence of the two end portions along the axial direction. Thus, this arrangement makes it difficult for the door main body to come into contact with other object located on the wall side or opposite side of the door main body, which makes it easier for the door main body to be moved smoothly along the slide direction.

Also, the at least one displacing mechanism preferably includes at least one movable member which is moved by the door main body when the door main body is moved to the closing position, wherein each of at least one movable member preferably has a moved portion which is pushed and moved by the door main body being moved to the closing position, and a pressing portion configured to push the door main body toward the wall as the moved portion is moved.

With such an arrangement, when the door main body is moved to the closing position, the moved portion is pushed and moved by the door main body. And the pressing portion is moved as the moved portion is moved. And as a result of the fact that the door main body is pushed toward the wall by the pressing portion that is being moved, the door main body can be moved closer to the wall to improve the tightness of the closure of the opening by the door main body.

In addition, each of the at least one movable member preferably further includes a connecting portion which connects the moved portion and the pressing portion to each other, and a rotatably supporting portion which supports the connecting portion such that the connecting portion is rotatable with respect to the wall, wherein the moved portion is preferably connected to a first portion of the connecting portion that is located to one side of the rotatably supporting portion whereas the pressing portion is preferably connected to a second portion of the connecting portion that is located to the other side of the rotatably supporting portion, wherein the connecting portion is preferably formed to have a shape that is bent such that the first portion extends along a direction that intersects a direction along which the second portion extends, as seen along an opposing direction which is a direction perpendicular to the first opposing surface, wherein the moved portion is preferably pushed and moved by the door main body being moved to the closing position, wherein the pressing portion preferably has a pressing surface which is caused to contact an non-opposing surface of the door main body, that is on an opposite side of the door main body from the first opposing surface, by a pivoting movement of the movable member with the rotatably supporting portion located in an area of a center of the pivoting movement that accompanies the movement of the moved portion, and wherein the pressing surface is preferably a sloped surface that is sloped such that the sloped surface is spaced farther from the wall toward an edge of the pressing surface along a direction of the pivoting movement of the movable member, where the edge of the pressing surface is one closer to an edge of the non-opposing surface.

With such an arrangement, the door main body can be pushed and moved closer to the wall by the pressing surface provided in the pressing portion which is moved together with the moved portion, and by utilizing the energy from the movement of the door main body that is being moved to the closing position. Therefore, it is not necessary to provide a complex mechanism for moving the moved portion as the pressing portion is moved. Thus, the structure of the movable member can be made simple.

INDUSTRIAL APPLICABILITY

The technology related to the present disclosure can be used as a sliding fire door provided to a wall having an opening formed therein.

What is claimed is:

1. A sliding fire door provided to a wall which has an opening formed therein, the sliding fire door comprising:

an opening frame at least a portion of which frames the opening;

a fire door comprising a door main body configured to leave open and close the opening;

a guiding mechanism configured to guide the door main body along a slide direction parallel to the wall;

wherein the guiding mechanism includes a plurality of support rollers arranged one adjacent to another along the slide direction, wherein the guiding mechanism is configured to guide the door main body such that the door main body is allowed to be moved along the slide direction from an opening position for leaving open the opening to a closing position for closing the opening, wherein the plurality of support rollers support a weight of the door main body with a peripheral surface that surrounds an axis of rotation, and the plurality of support rollers are fixed to the opening frame via the axis of rotation, wherein the door main body has a first opposing surface which is oriented toward the wall, wherein the opening frame has a second opposing surface which is oriented toward the first opposing surface of the door main body in the closing position, and wherein the guiding mechanism includes at least one displacing mechanism configured to move the door main body in such a direction as to cause the first opposing surface to be moved closer to the second opposing surface, when the door main body is moved from the opening position to the closing position.

2. The sliding fire door as defined in claim 1, wherein the slide direction is a horizontal direction, wherein the door main body is arranged in such an attitude that the door main body extends along a vertical direction and along the slide direction, wherein the plurality of the support rollers include one or more opening position support rollers each of which supports a portion of the weight of the door main body when the door main body is in the opening position, and one or more closing position support rollers each of which supports a portion of the weight of the door main body when the door main body is in the closing position, wherein a shape of a peripheral surface or peripheral surfaces of the one or more opening position support rollers is different from a shape of a peripheral surface or peripheral surfaces of the one or more closing position support rollers, wherein at least a portion of the peripheral surface of each of the one or more closing position support rollers is a sloped surface whose radius decreases toward an end thereof that is closer to the wall, and wherein the one or more closing position support rollers function as one of the at least one displacing mechanism.

3. The sliding fire door as defined in claim 2, wherein a radius of an end portion, on a side closer to the wall, of the peripheral surface of each of the one or more opening position support rollers is greater than a radius of an end portion, on a side closer to the wall, of the peripheral surface of each of the one or more closing position support rollers, and wherein, one of the plurality of support rollers that is located to an open position side of, and closest to, a rearward end, along the slide direction, of the door main body when the door main body is in the closing position is one of the one or more opening position support rollers.

4. The sliding fire door as defined in claim 2, wherein one or more relay support rollers, each of which has a peripheral surface of a shape that is intermediate between the shape of the peripheral surface of each of the one or more opening position support rollers and the shape of the peripheral surface of each of the one or more closing position support rollers, are located between the one or more opening position support rollers and the one or more closing position support rollers along the slide direction.

5. The sliding fire door as defined in claim 2, wherein the peripheral surface of each of the one or more opening position support rollers is formed such that a radius of an intermediate portion of the peripheral surface along an axial direction is less than a radius or radii of two end portions, along the axial direction, of the peripheral surface.

6. A sliding fire door provided to a wall which has an opening formed therein, the sliding fire door comprising:

an opening frame at least a portion of which frames the opening;

a fire door comprising a door main body configured to leave open and close the opening;

a guiding mechanism configured to guide the door main body along a slide direction parallel to the wall;

wherein the guiding mechanism includes a guide roller group which includes a plurality of guide rollers arranged one adjacent to another along the slide direction and which is configured to guide the door main body, wherein the guiding mechanism is configured to guide the door main body such that the door main body is allowed to be moved along the slide direction from an opening position for leaving open the opening to a closing position for closing the opening, wherein the door main body has a first opposing surface which is oriented toward the wall, wherein the opening frame has a second opposing surface which is oriented toward the first opposing surface of the door main body in the closing position, and wherein the guiding mechanism includes at least one displacing mechanism configured to move the door main body in such a direction as to cause the first opposing surface to be moved closer to the second opposing surface, when the door main body is moved from the opening position to the closing position, wherein the at least one displacing mechanism includes at least one movable member which is moved by the door main body when the door main body is moved to the closing position, and wherein each of at least one movable member has a moved portion which is pushed and moved by the door main body being moved to the closing position, and a pressing portion configured to push the door main body toward the wall as the moved portion is moved.

7. The sliding fire door as defined in claim 6, wherein each of the at least one movable member further includes a connecting portion which connects the moved portion and the pressing portion to each other, and a rotatably supporting portion which supports the connecting portion such that the connecting portion is rotatable with respect to the wall, wherein the moved portion is connected to a first portion of the connecting portion that is located to one side of the rotatably supporting portion whereas the pressing portion is connected to a second portion of the connecting portion that is located to the other side of the rotatably supporting portion, wherein the connecting portion is formed to have a shape that is bent such that the first portion extends along a direction that intersects a direction along which the second portion extends, as seen along an opposing direction which is a direction perpendicular to the first opposing surface, wherein the moved portion is pushed and moved by the door main body being moved to the closing position, wherein the pressing portion has a pressing surface which is caused to contact an non-opposing surface of the door main body, that is on an opposite side of the door main body from the first opposing surface, by a pivoting movement of the movable member with the rotatably supporting portion located in an area of a center of the pivoting movement that accompanies the movement of the moved portion, and wherein the pressing surface is a sloped surface that is sloped such that the sloped surface is spaced farther from the wall toward an edge of the pressing surface along a direction of the pivoting movement of the movable member, where the edge of the pressing surface is one closer to an edge of the non-opposing surface.

* * * * *